United States Patent [19]

Takamura

[11] Patent Number: 4,823,538

[45] Date of Patent: Apr. 25, 1989

[54] BAGGING MACHINE

[75] Inventor: Yoshiyuki Takamura, Nagoya, Japan

[73] Assignee: Fuji Pack System Ltd., Aichi, Japan

[21] Appl. No.: 55,630

[22] Filed: May 29, 1987

[30] Foreign Application Priority Data

| | | | |
|---|---|---|---|
| May 30, 1986 | [JP] | Japan | 61-126455 |
| Jun. 19, 1986 | [JP] | Japan | 61-143461 |
| Sep. 11, 1986 | [JP] | Japan | 61-139584 |
| Feb. 3, 1987 | [JP] | Japan | 62-24359 |

[51] Int. Cl.[4] ..... B65B 31/06; B65B 43/18

[52] U.S. Cl. ..... 53/512; 53/266 R; 53/386; 53/573

[58] Field of Search ..... 53/266 R, 386, 469, 53/512, 573

[56] References Cited

U.S. PATENT DOCUMENTS

| | | | |
|---|---|---|---|
| 3,501,893 | 3/1970 | Peterson | 53/573 |
| 3,566,578 | 3/1971 | Thorne | 53/573 X |
| 3,673,759 | 7/1972 | Ayres | 53/573 X |
| 4,174,599 | 11/1979 | Callete | 53/512 |
| 4,432,186 | 2/1984 | McGregor | 53/573 X |

FOREIGN PATENT DOCUMENTS

| | | |
|---|---|---|
| 54-29956 | 9/1979 | Japan . |
| 59-174413 | 10/1984 | Japan . |

*Primary Examiner*—John Sipos

*Attorney, Agent, or Firm*—Michael D. Rechtin; Philip P. Mann

[57] ABSTRACT

A bagging machine comprising a bag supply device, a bag-opening device, a bag-sealing device mounted on one side of the bag-opening device, and a bag-moving device. The bag supply device includes a mounting member and a first bag-attracting portion mounted to the mounting member that reciprocates between a bag supply position and a bag opening position. The bag-opening device has a second bag-attracting portion which faces the first bag-attracting portion when the mounting member of the bag supply device is in the bag opening position. The second bag-opening portion can move toward and away from the first bag-attracting portion. The bag-moving device has a pair of openable holding members. The holding members reciprocate between the bag-opening device and the bag-sealing device, and close the opening of a bag by holding the opening between themselves.

29 Claims, 28 Drawing Sheets

BAGGING MACHINE

FIELD OF THE INVENTION

The present invention relates to a bagging machine for putting various articles into bags made of resin or other material and sealing the openings of the bags.

DESCRIPTION OF THE RELATED ART

A bagging machine performs the functions of at least supplying a bag, opening it, putting an article into the bag, and sealing the opening of the bag. Depending on the kind o the article, the machine further performs deaerating the bag and admitting liquid or gas into it for preserving the article.

In a known bagging machine as disclosed in Japanese Patent Laid-Open No. 174,413/1984, devices for carrying out various bagging steps are disposed along an endless main chain. In another known bagging machine, devices for performing various bagging steps are arranged so that they move along a circular path. These known machines have the disadvantage that they are bulky. Accordingly, a new bagging machine has been required in which the components used for various bagging steps are installed compactly and which has an improved productivity.

In order to bag mushrooms or similar articles which usually spread in every direction , a special article supply device is needed because of the shape of the articles. Also, a device for deaerating bags is necessitated to preserve the articles. However, these devices are not always necessary when the kind of article is not taken into account.

SUMMARY OF THE INVENTION

It is an object of the invention to provide a bagging machine which is compact and has an improved productivity.

It is another object of the invention to provide a bagging machine which is capable of deaerating bags or introducing liquid or gas to preserve articles.

The above objects are achieved by a bagging machine comprising: a bag supply device composed of a mounting member and a first bag-attracting portion mounted to the mounting member which reciprocates between a bag supply position and a bag opening position; a bag-opening device having a second bag-attracting portion which faces the first bag-attracting portion when the mounting member of the bag supply device is in the bag opening position, the second bag-attracting portion being movable toward and away from the first bag-attracting portion; a bag-sealing device mounted on one side of the bag-opening device; and a bag-moving device having a pair of openable holding members which reciprocates between the bag-opening device and the bag-sealing device, the holding members being capable of holding the opening of a bag between themselves to keep the opening closed.

Other objects of the invention will become obvious upon an understanding of the illustrative embodiments about to be described or will be indicated in the appended claims, and various advantages not referred to herein will occur to one skilled in the art upon employment of the invention in practice. BRIEF DESCRIPTION OF THE DRAWINGS FIG. 1 is a plan view of a bagging machine according to the invention, for showing the manner in which a bag is supplied and simultaneously deaerated;

Figure 1:
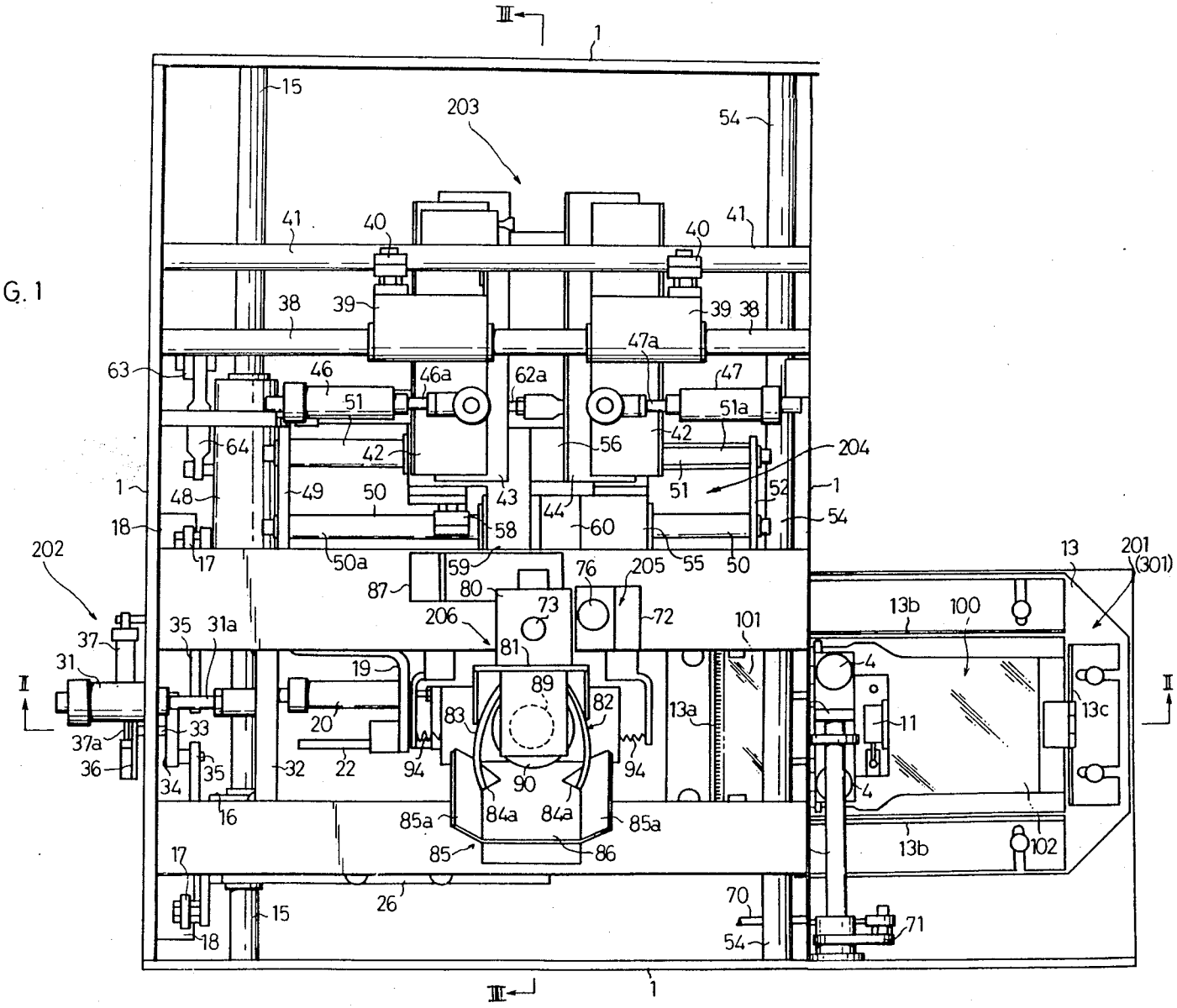
Figure 16:
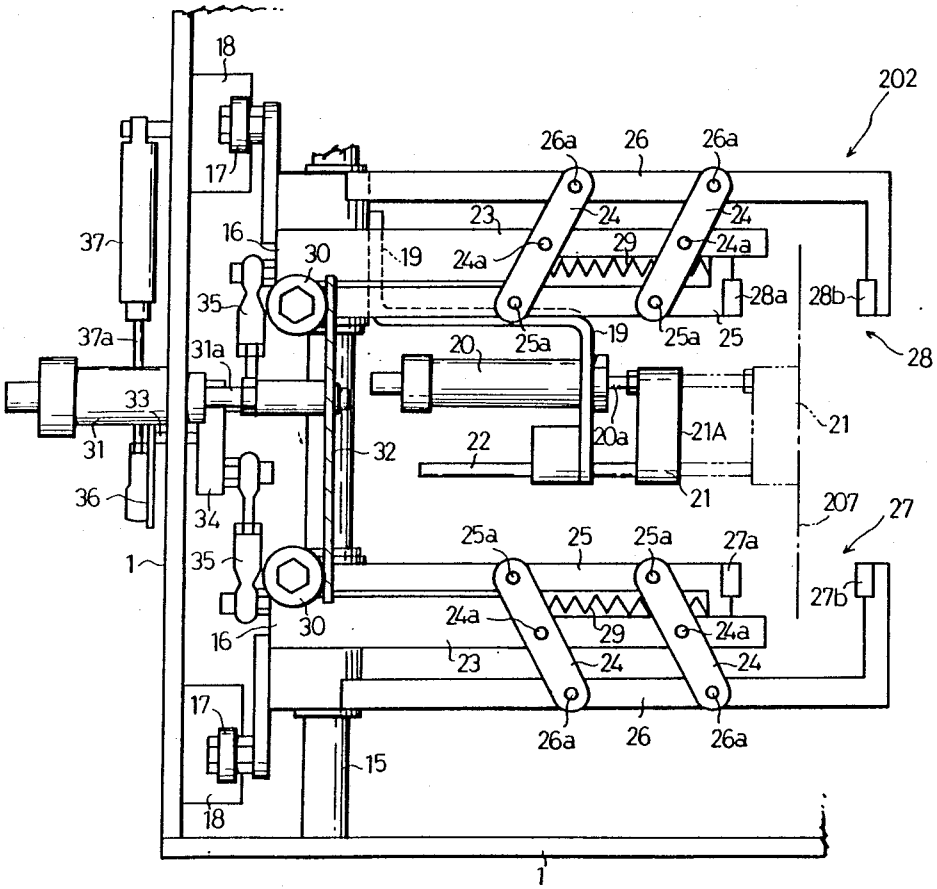
FIG. 16 is a fragmentary enlarged plan view of the bag-opening device shown in FIGS. 14 and 15, and in which the clamps of the opening device are open.
Figure 14:
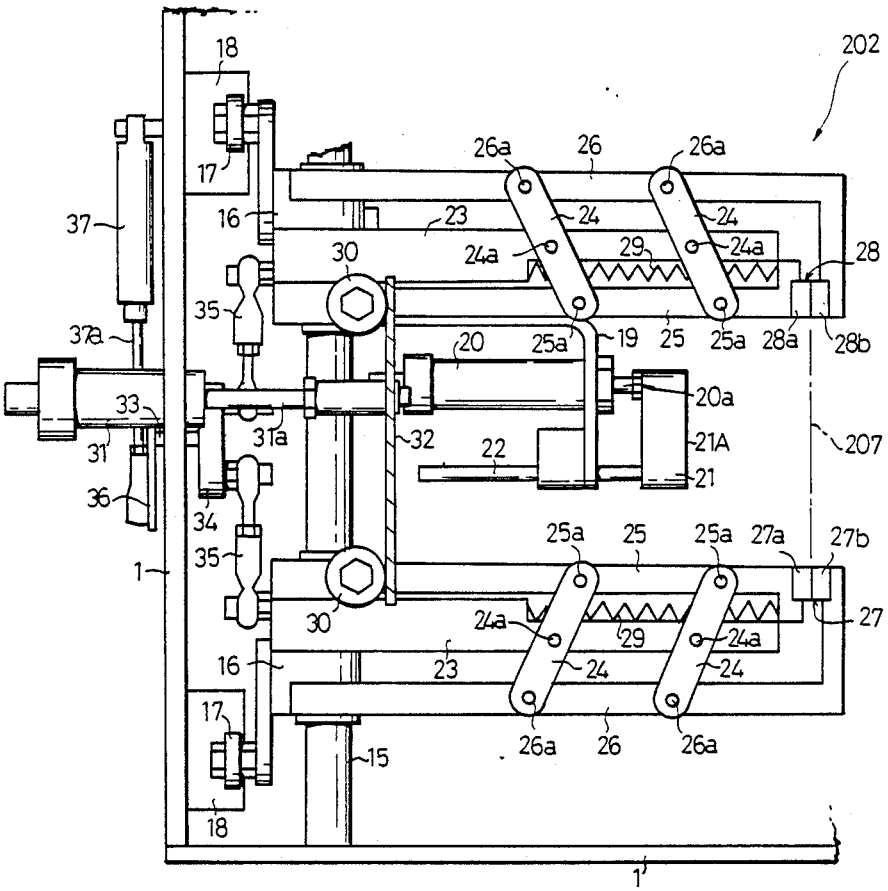
FIG. 14 is a fragmentary enlarged plan view of the bag-opening device of the bagging machine shown in FIG. 1, and in which the bagging machine is under the same condition as in FIG. 1.
Figure 15:
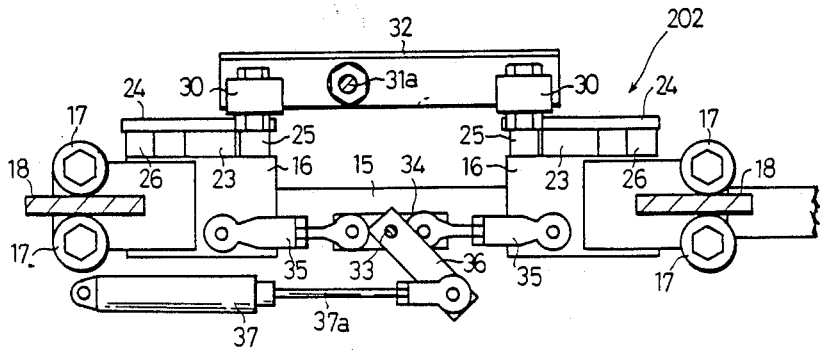
FIG. 15 is a fragmentary enlarged left side elevation of the bag-opening device shown in FIG. 14.
Figure 17A:
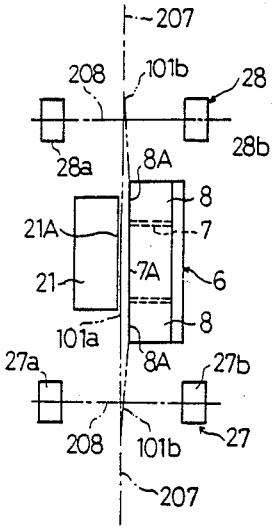
Figure 17B:
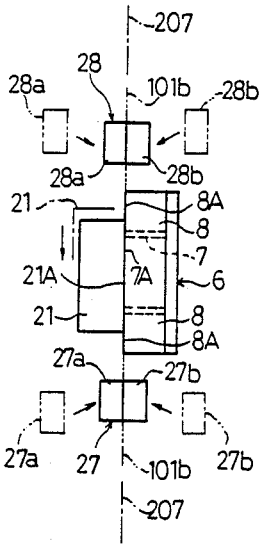
Figure 17C:
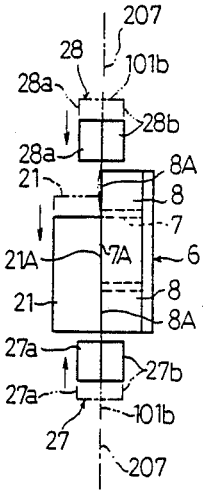
Figure 17D:
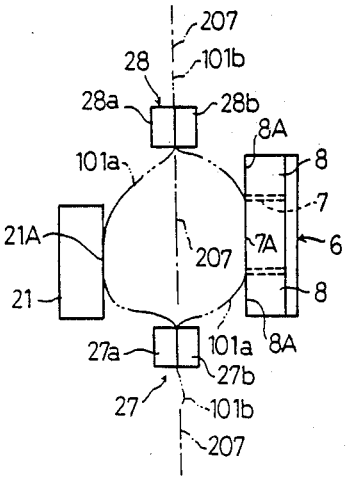
Figure 17E:
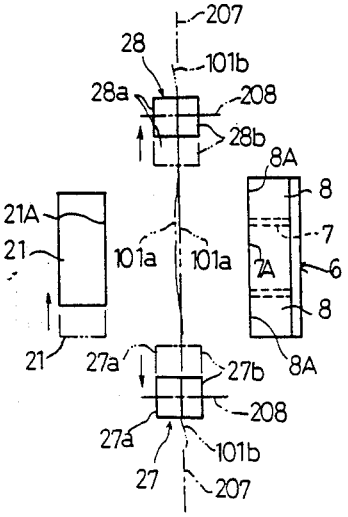
Figure 18:
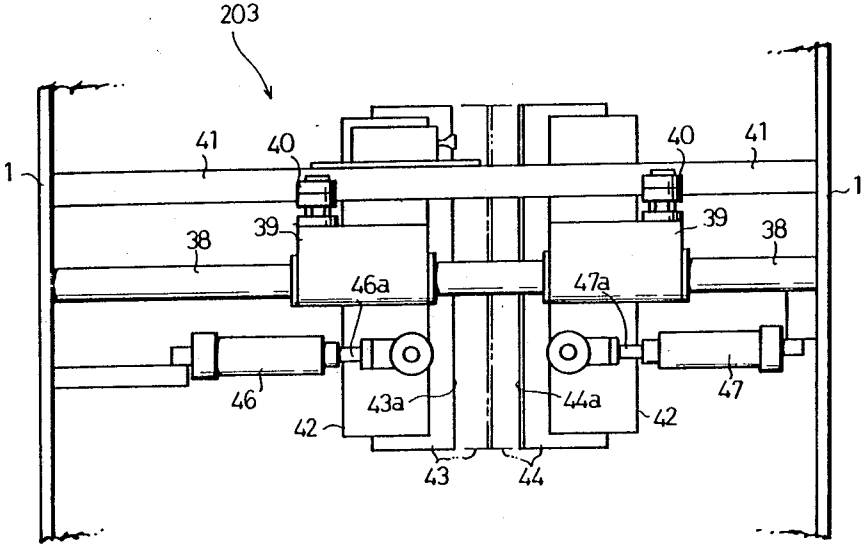
Figure 19:
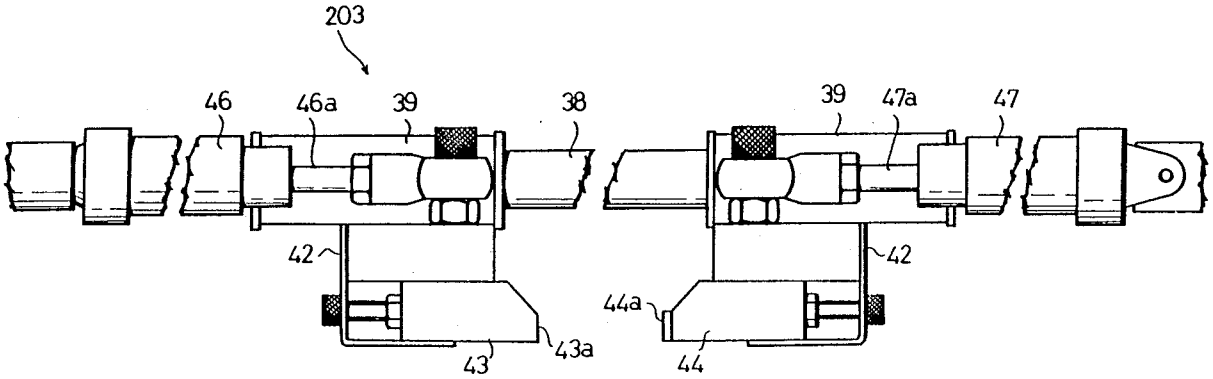
Figure 20:
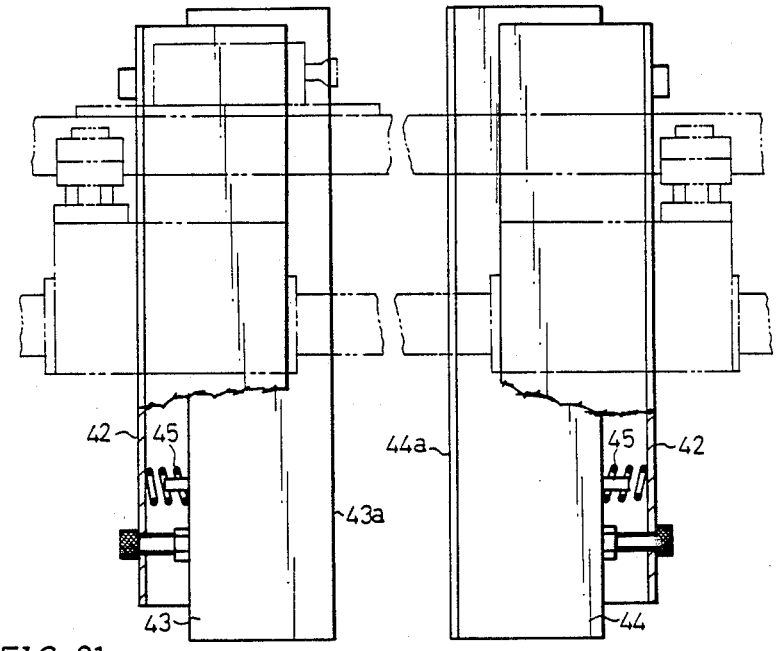
Figure 21:
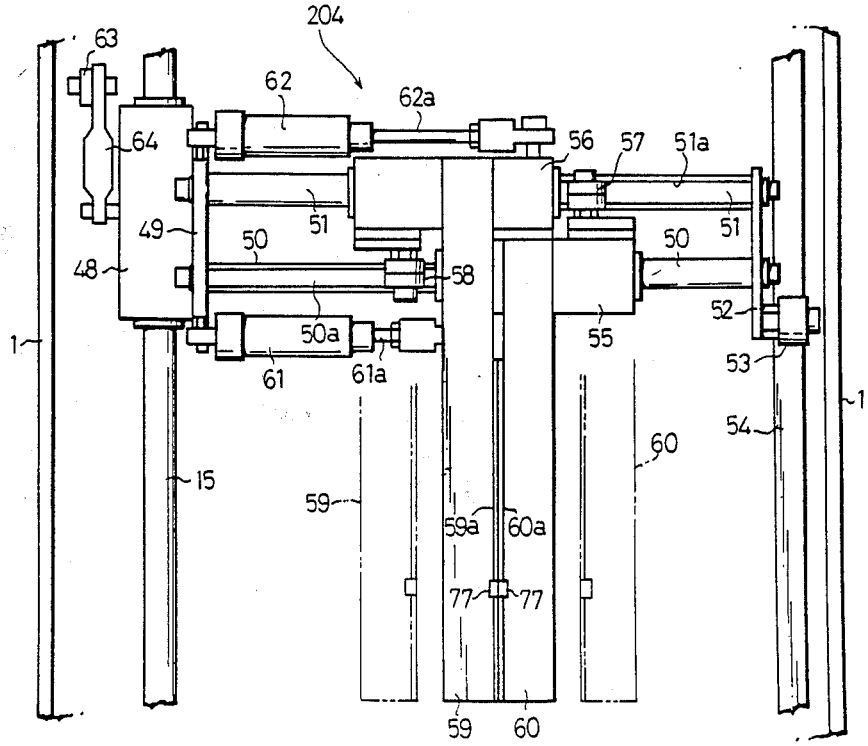
Figure 22:
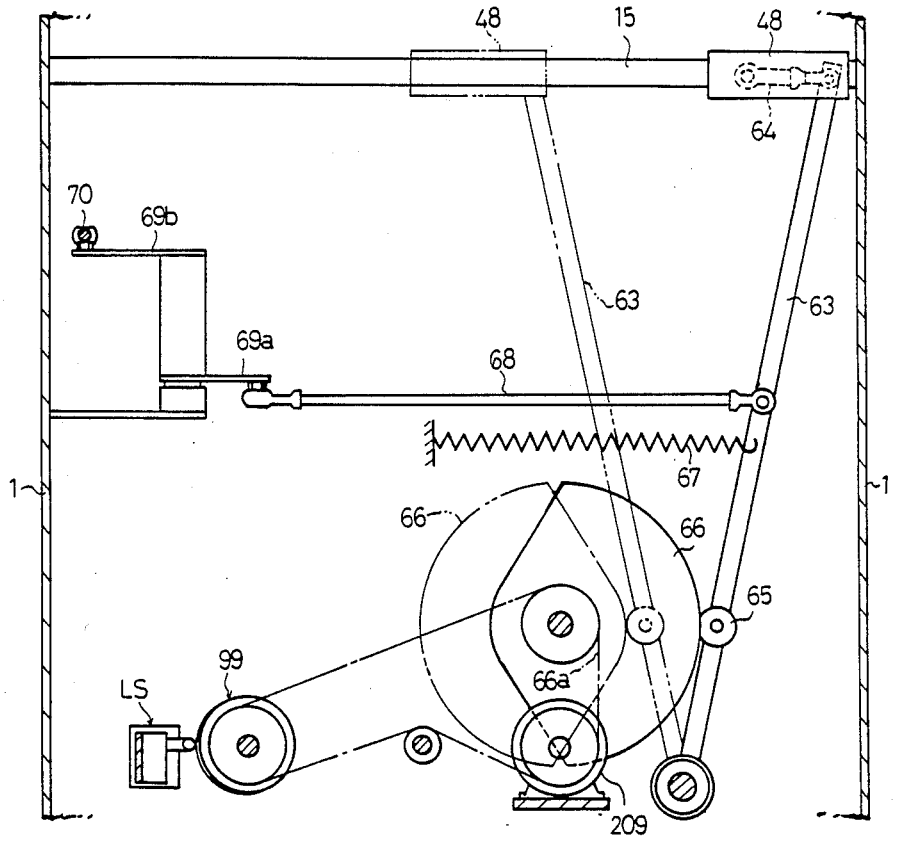
Figure 23:
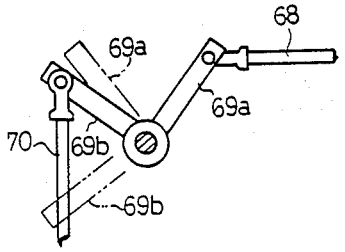
Figure 24:
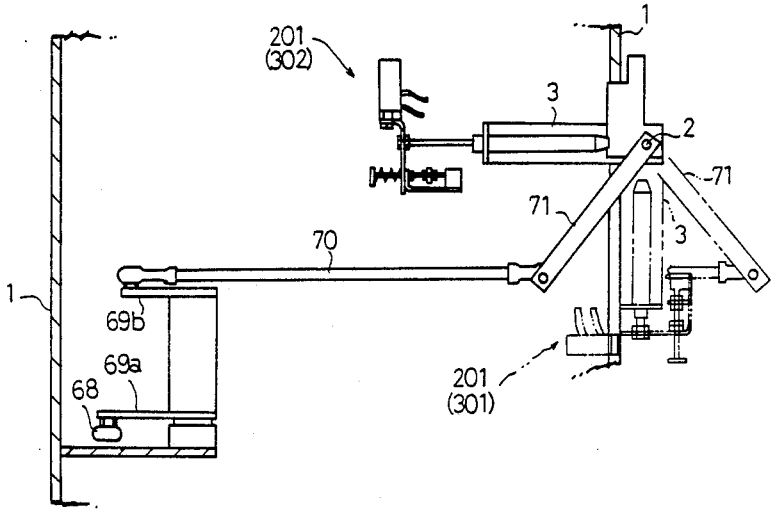
Figure 48:
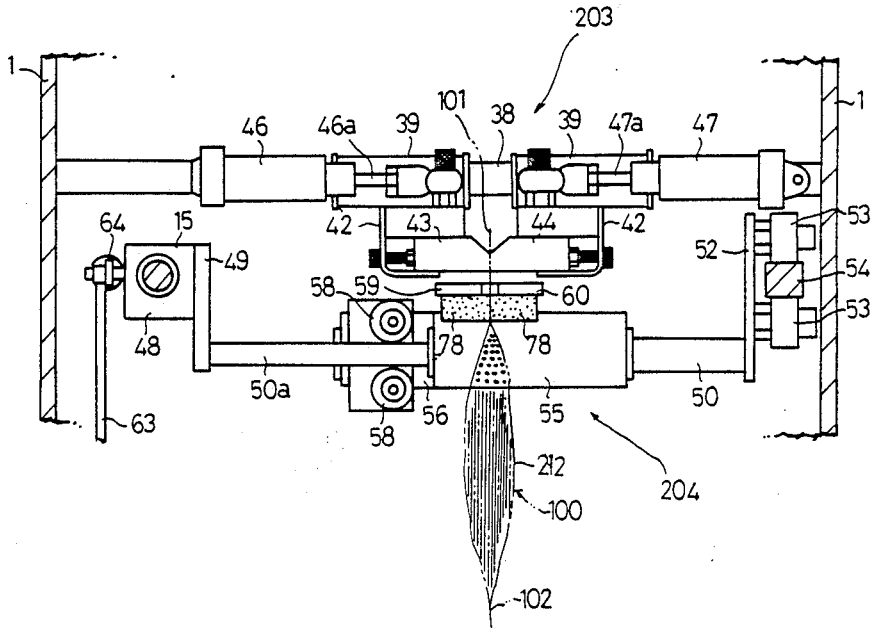
Figure 25:
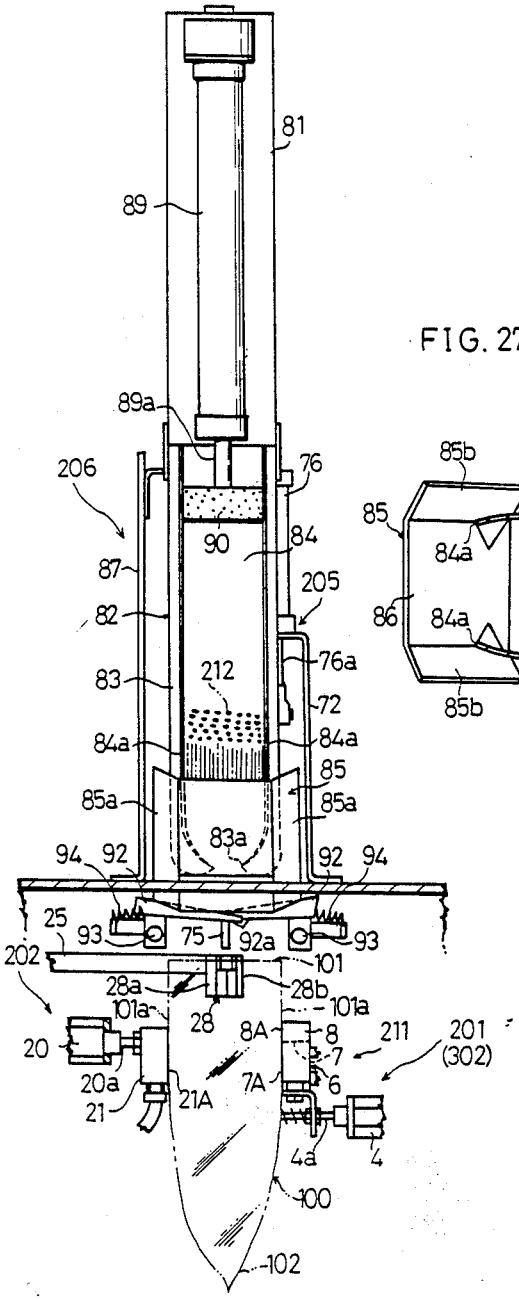
Figure 27:
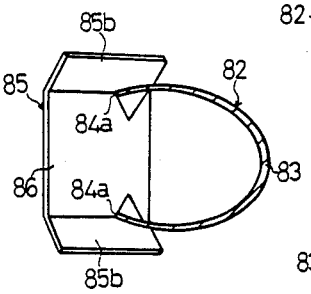
Figure 26:
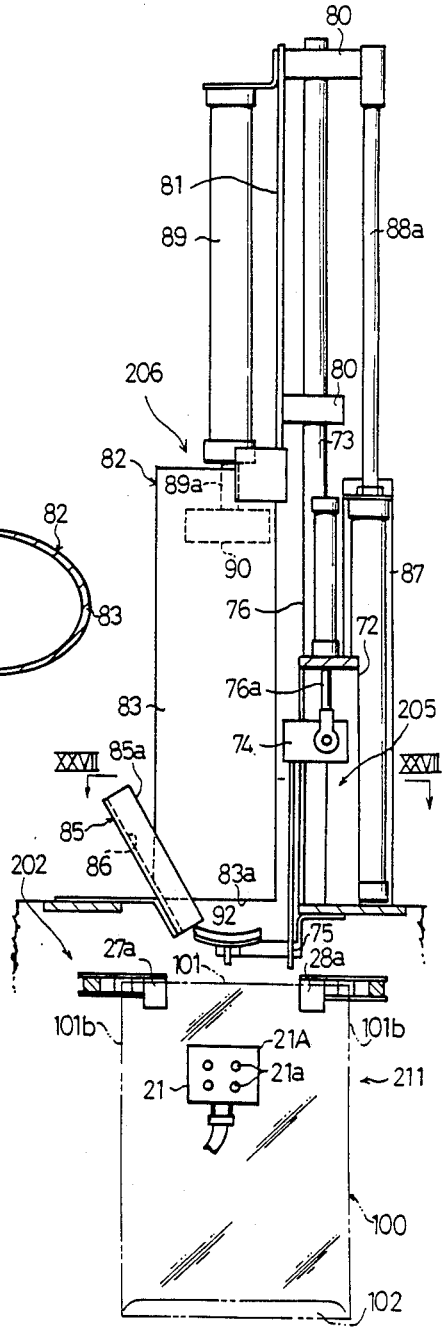
Figure 28:
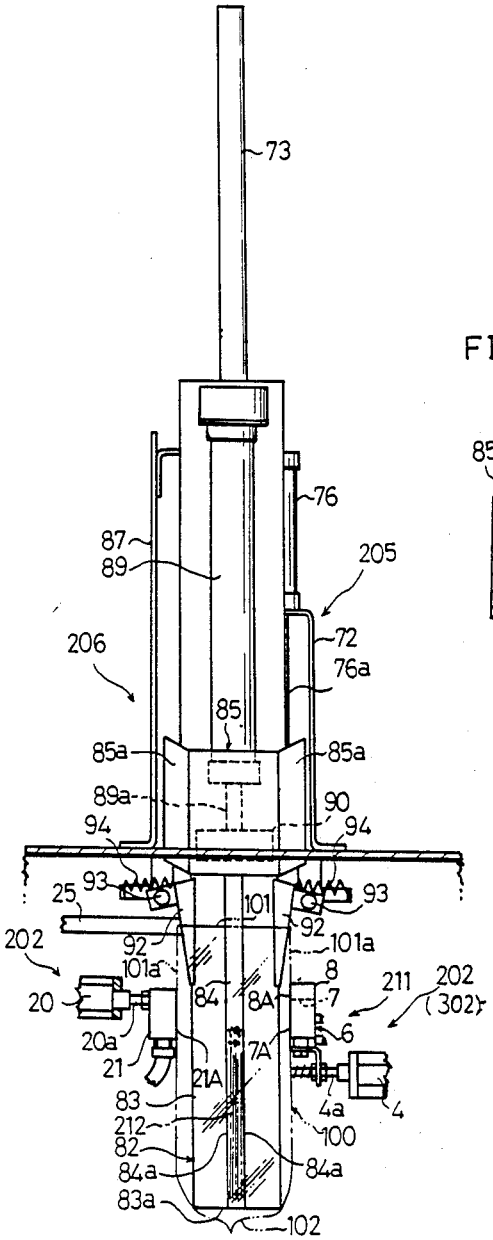
Figure 29:
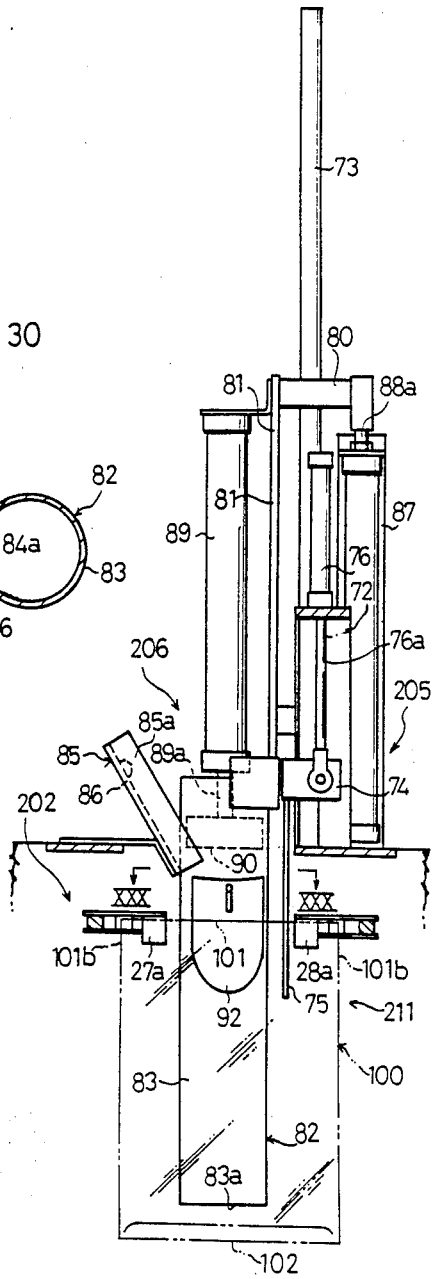
Figure 30:
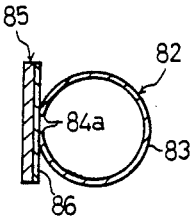
Figure 35:
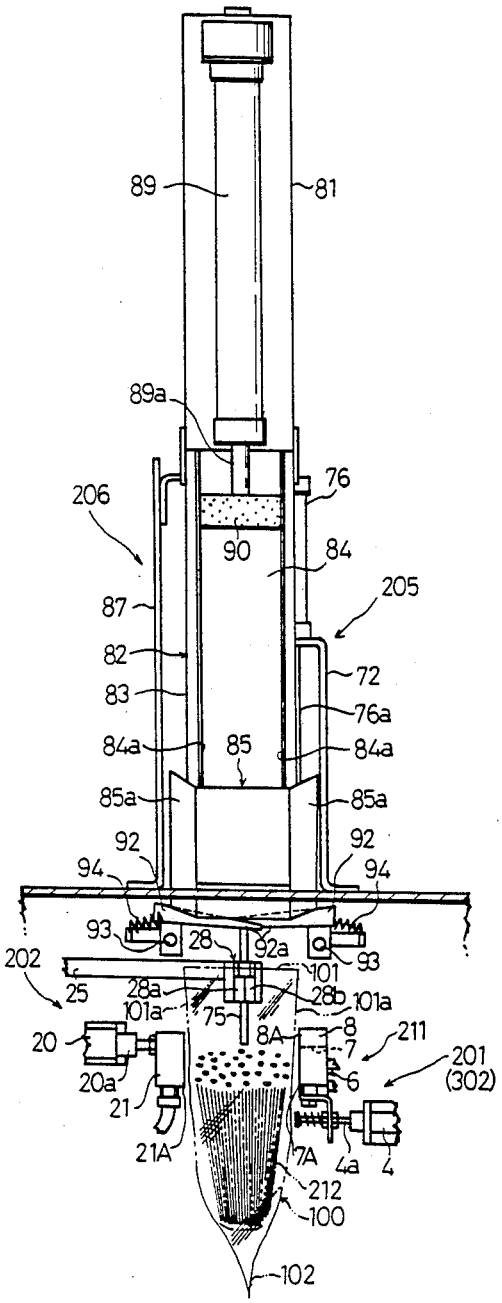
Figure 36:
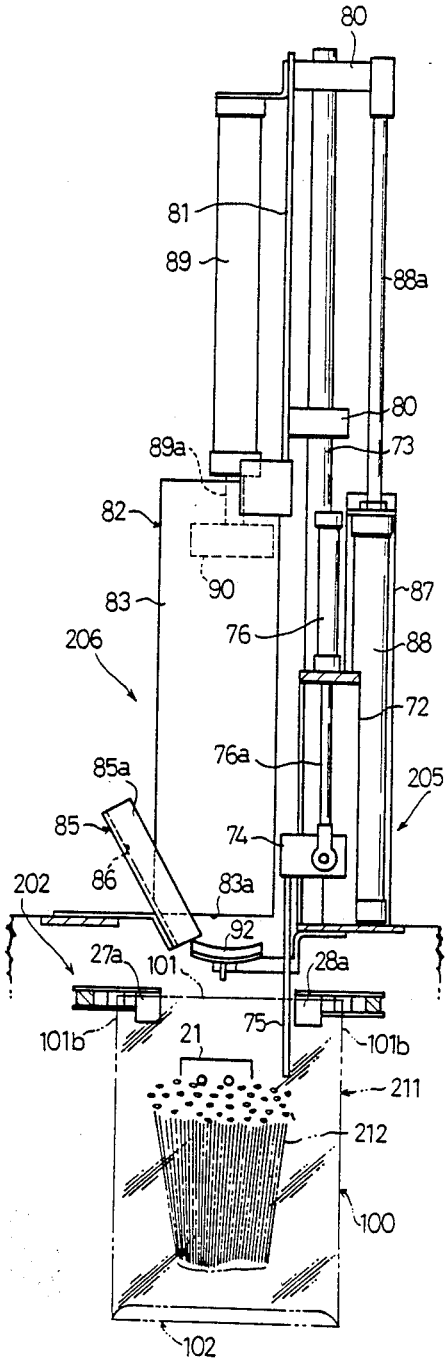
Figure 37:
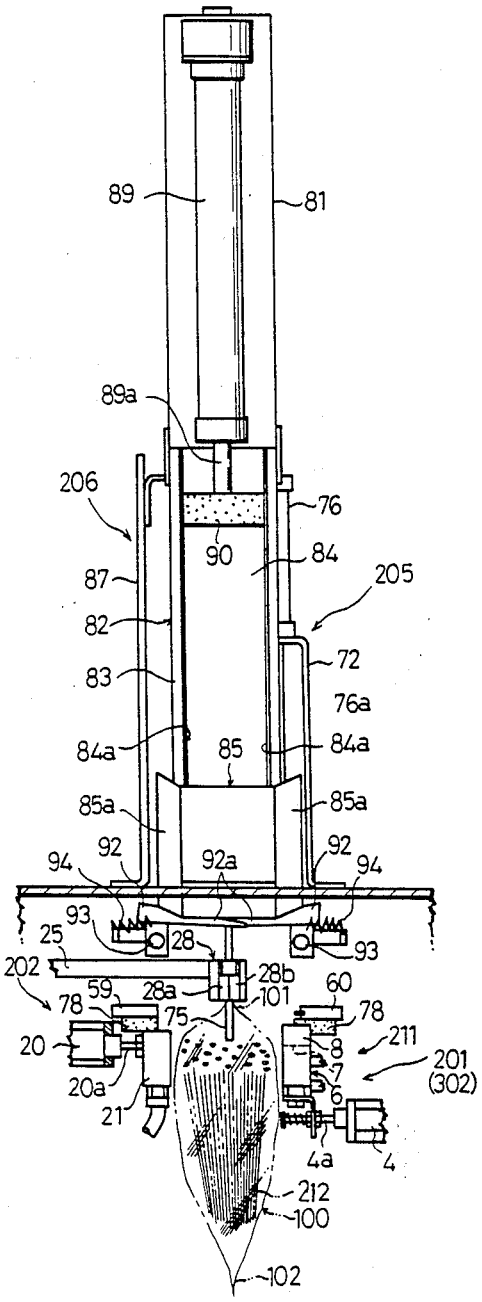
Figure 38:
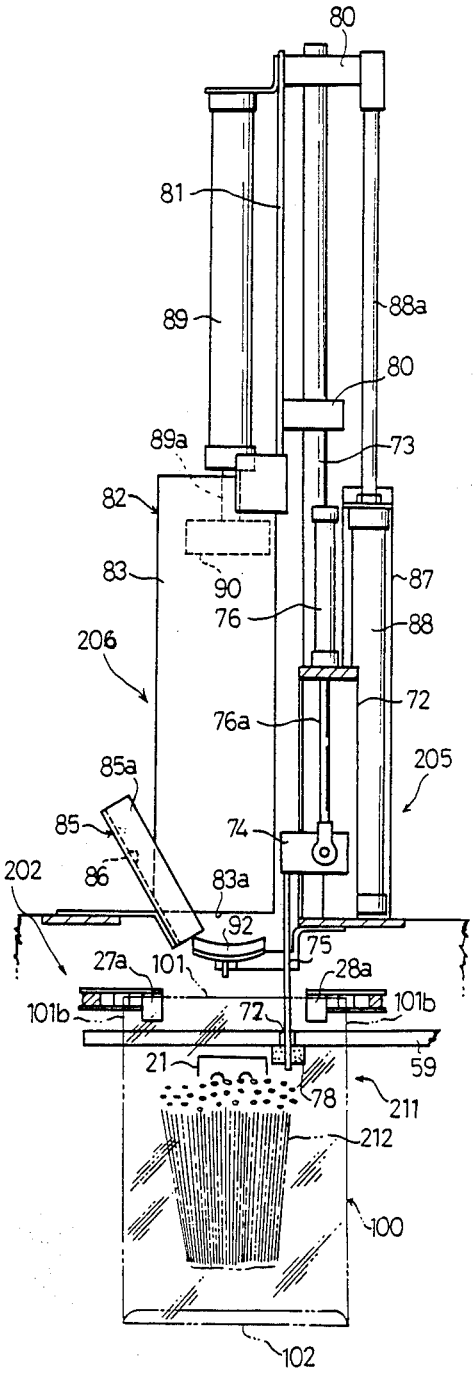
Figure 39:
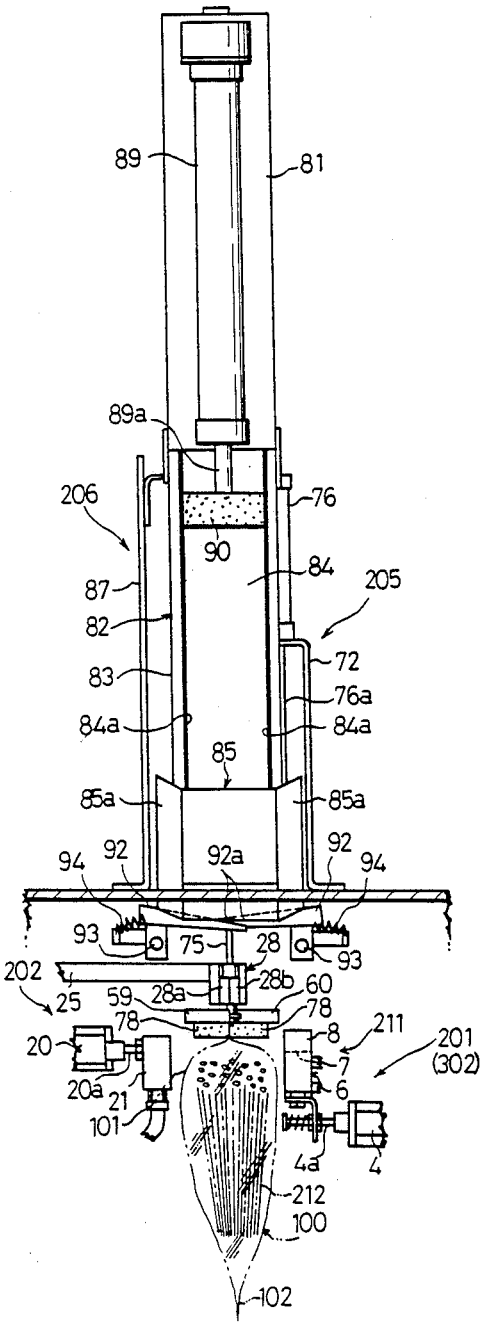
Figure 40:
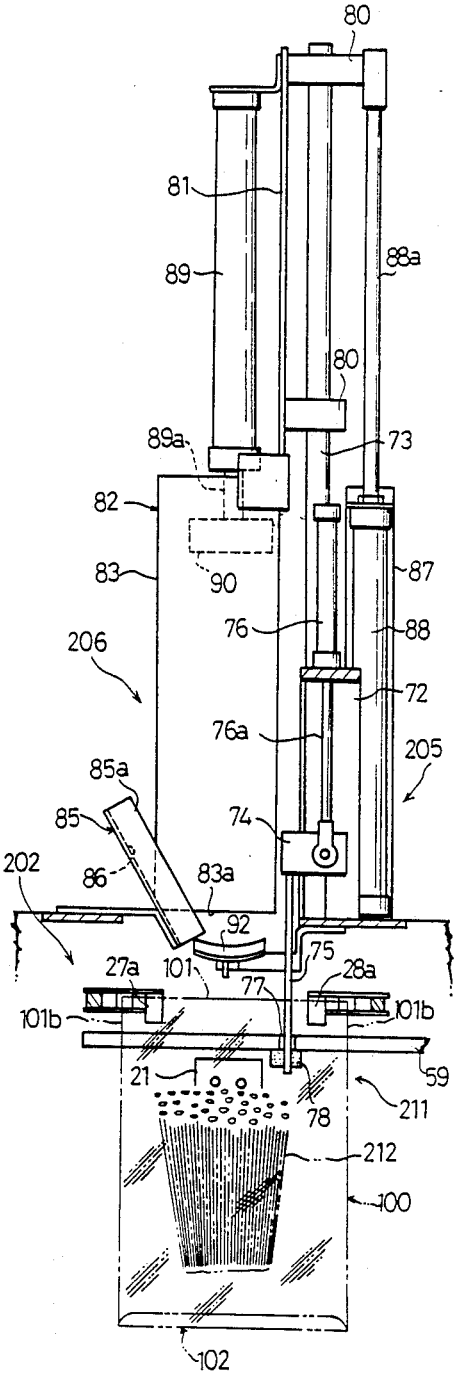
Figure 41:
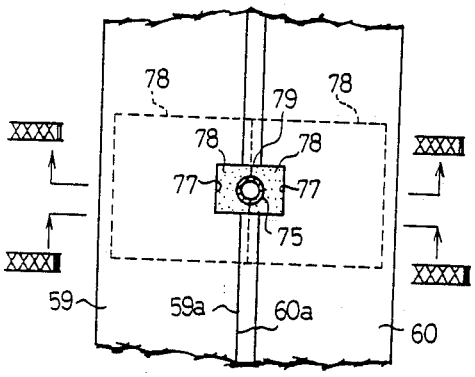
Figure 44:
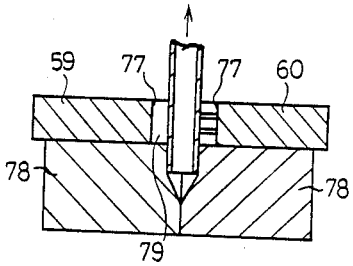
Figure 42:
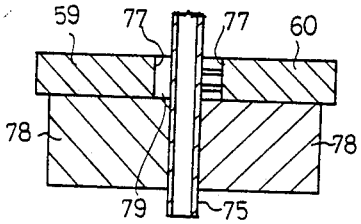
Figure 45:
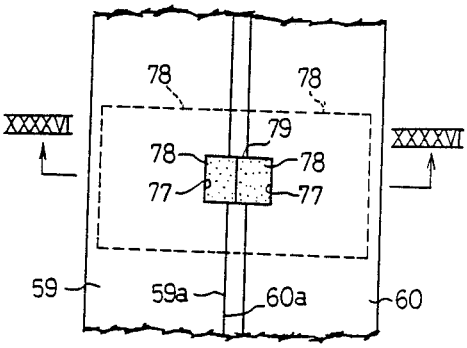
Figure 43:
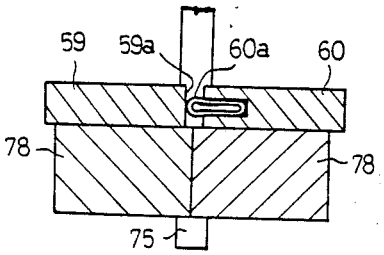
Figure 46:
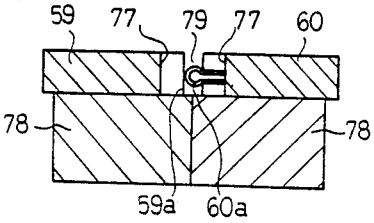
Figure 47:
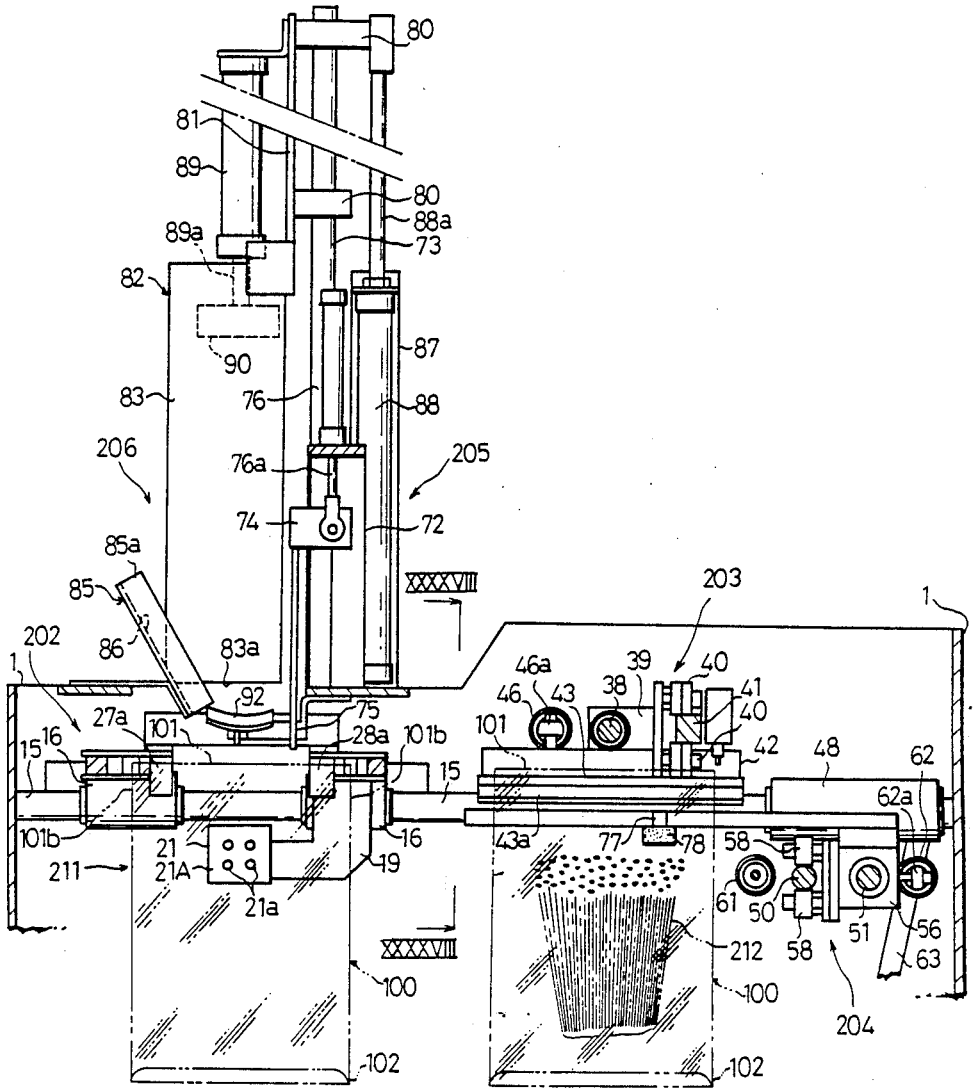
Figure 49:
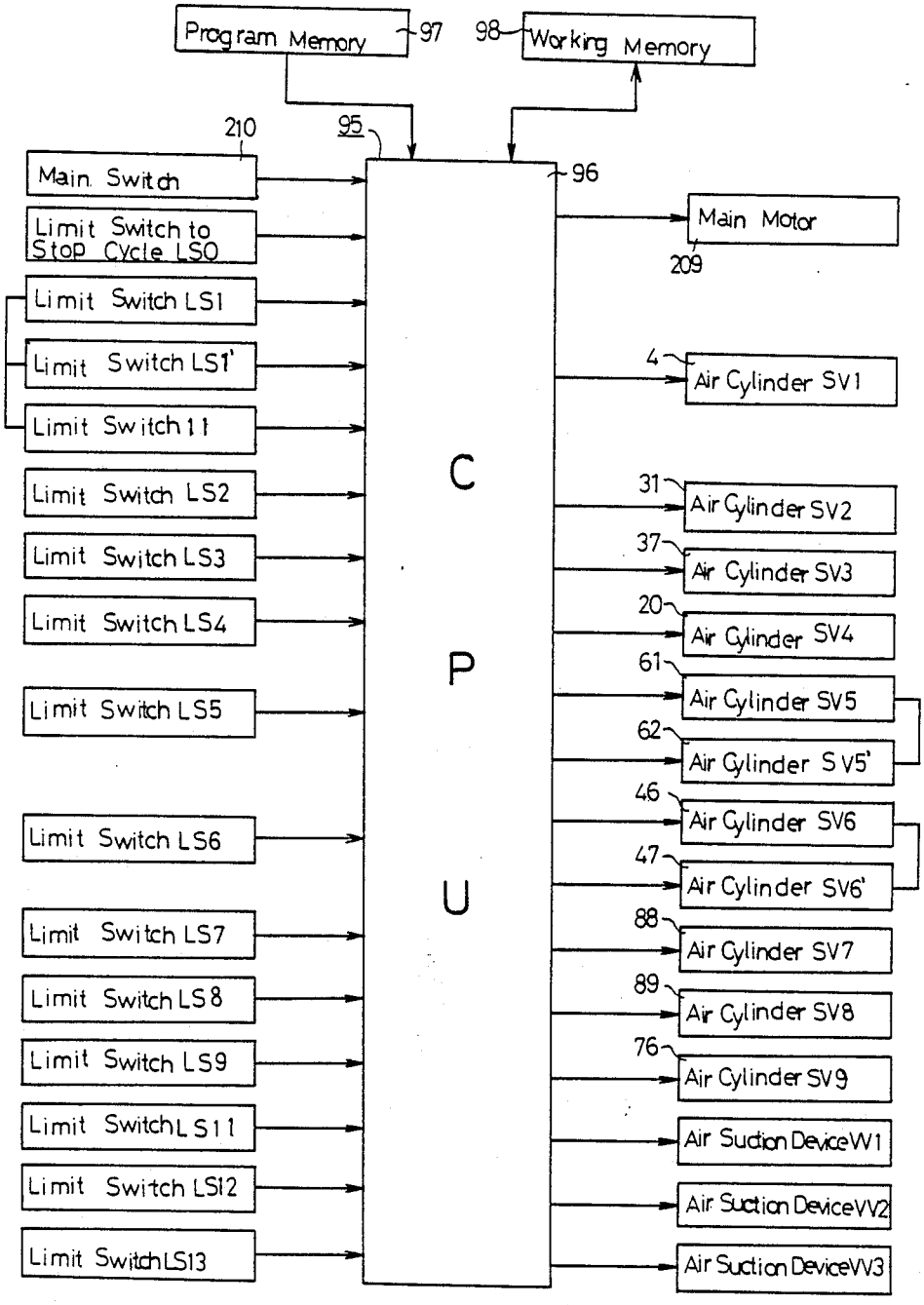

FIGS. 17(*a*)–17(*e*) are diagrams for illustrating the manner in which a bag is opened by the bag-opening device shown in FIGS. 14–16;

FIG. 18 is a fragmentary enlarged plan view of the bag-sealing device of the bagging machine shown in FIG. 1, and in which the bagging machine is under the same condition as in FIG. 1;

FIG. 19 is a fragmentary enlarged front elevation of the bag-sealing device shown in FIG. 18;

FIG. 20 is a fragmentary enlarged plan view of the bag-sealing device shown in FIGS. 18 and 19;

FIG. 21 is a fragmentary enlarged plan view of the bag-moving device of the bagging machine shown in FIG. 1, and in which the bagging machine is under the same condition as in FIG. 1;

FIG. 22 is a fragmentary enlarged right side elevation of a reciprocating mechanism for the bag-moving device shown in FIG. 21 and an interlocking mechanism for interlocking the bag-moving device with the bag supply device shown in FIGS. 7–11;

FIG. 23 is a fragmentary enlarged plan view of the interlocking mechanism shown in FIG. 22;

FIG. 24 is a fragmentary enlarged front elevation of the interlocking mechanism shown in FIGS. 22 and 23;

FIG. 25 is a front elevation partially in cross section of the deaerating nozzle-inserting device and the article supply device of the bagging machine shown in FIG. 1, and in which an article is about to be supplied;

FIG. 26 is a right side elevation partially in cross section of the inserting device and the article supply device shown in FIG. 25;

FIG. 27 is a cross-sectional view taken on line XXVII—XXVII of FIG. 26;

FIGS. 28 and 29 are fragmentary cross sections of the inserting device and the article supply device shown in FIGS. 25–27, for showing the manner in which an article supply cylinder and a suction nozzle have been lowered;

FIG. 30 is a cross-sectional view taken on line XXX—XXX of FIG. 29;

FIGS. 31–34 are partially cross-sectional views of the inserting device and the article supply device shown in FIGS. 25–30, for showing the manner in which the article supply cylinder is withdrawn from a bag after an article is put into the bag;

FIGS. 35 and 36 are partially cross-sectional views of the nozzle inserting device and the bag supply device, and in which first and second bag-attracting portions have stopped attracting a bag;

FIGS. 37 and 38 are views similar to FIGS. 35 and 36, but in which the shutter portion of the bag-moving device is located in the bag-opening device;

FIGS. 39 and 40 are views similar to FIGS. 37 and 38, but in which the shutter portion is closed;

FIG. 41 is a fragmentary enlarged plan view of the shutter portion shown in FIGS. 39 and 40;

FIG. 42 is a cross-sectional view taken on line XXXXII—XXXXII of FIG. 41;

FIG. 43 is a cross-sectional view taken on line XXXXIII—XXXXIII of FIG. 41; FIG. 44 is a view similar to FIG. 42, but in which a suction nozzle is being moved upward; FIG. 45 is a fragmentary enlarged plan view of the shutter portion shown in FIG. 41, for showing the manner in which the suction nozzle has been completely withdrawn; FIG. 46 is a cross-sectional view taken on line XXXXVI—XXXXVI of FIG. 45; FIG. 47 is a partially cross-sectional view of the bagging machine shown in FIG. 1, and in which the shutter portion of the bag-moving device is located in the bag-sealing device; FIG. 48 is a cross-sectional view taken on line XXXXVIII—XXXXVIII of FIG. 47; and FIG. 49 is a block diagram of the electric circuit of the bagging machine shown in FIG. 1.

DETAILED DESCRIPTION OF THE PREFERRED EMBODIMENT

Figure 2:
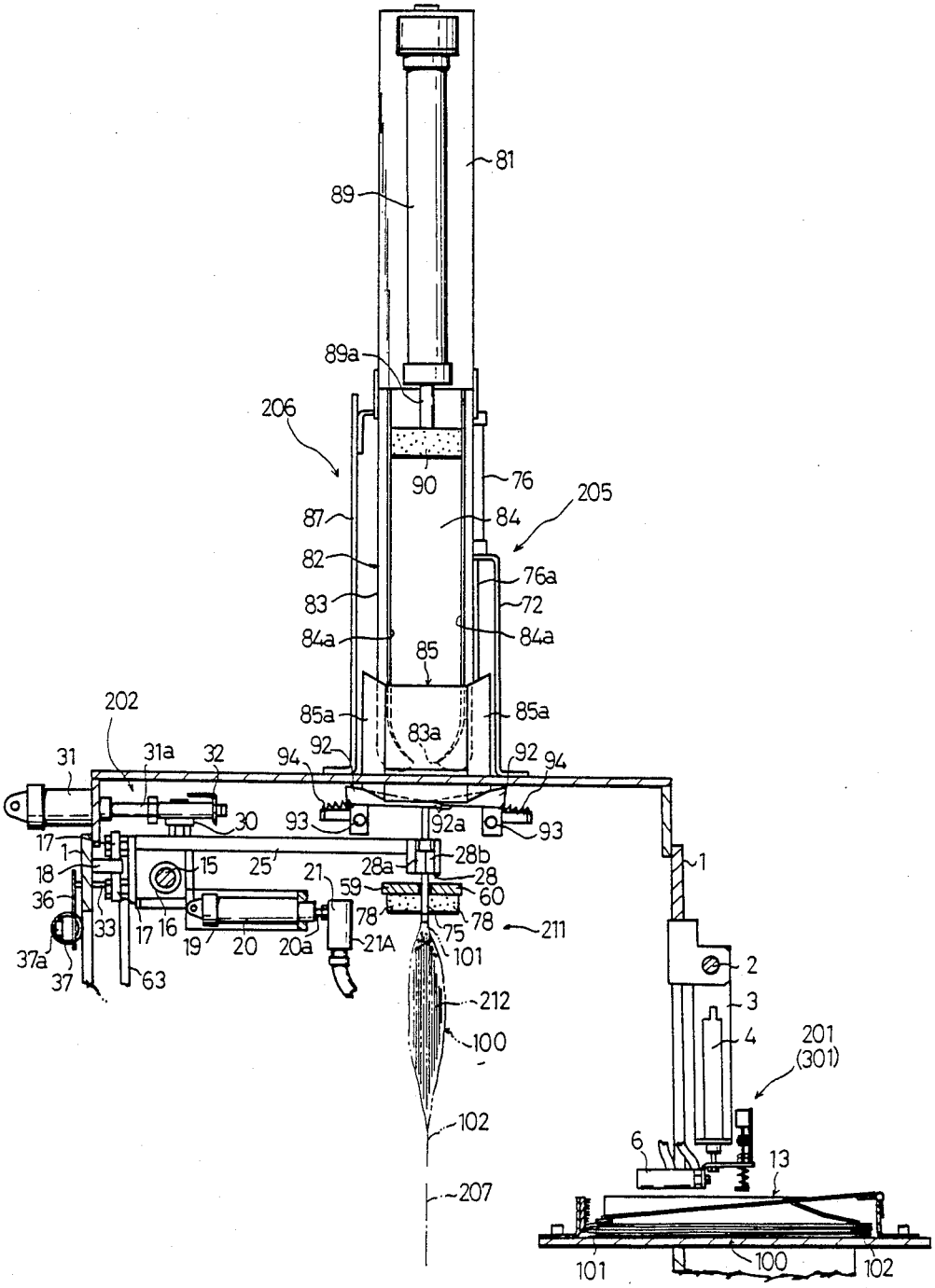
FIG. 2 is a fragmentary cross section taken on line II—II of FIG. 1.

Referring to FIGS. 1 and 2, there is shown a bagging machine embodying the concept of the present invention. This bagging machine is suited for bagging mushrooms or similar articles which usually spread in every direction. Disposed at the right of the front portion of the machine is a bag supply device 201, which is first described in detail below.

Figure 4:
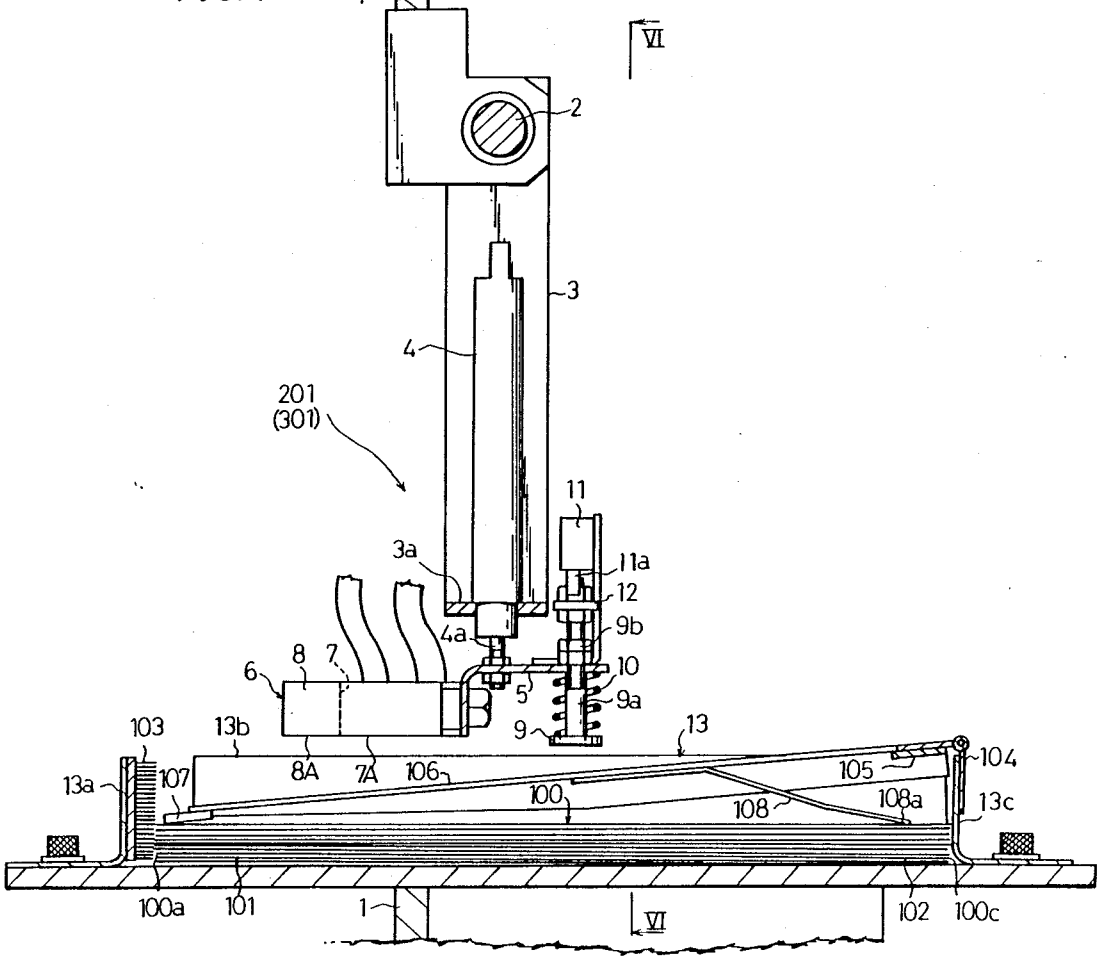
FIG. 4 is a fragmentary enlarged front elevation of the bag supply device of the bagging machine shown in FIG. 1, and in which a bag is not yet attracted.
Figure 5:
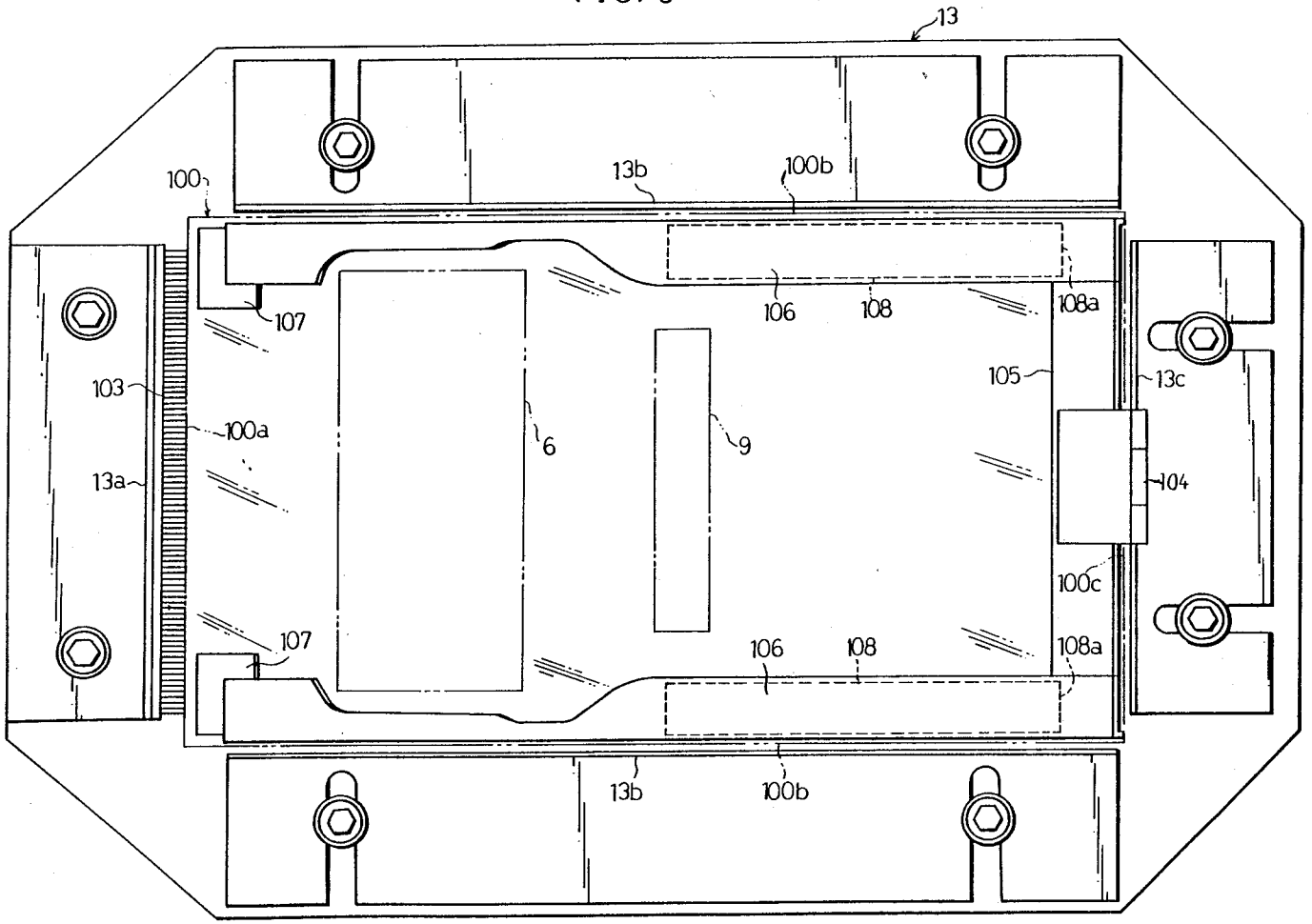
FIG. 5 is a plan view of the bag-receiving case shown in FIG. 1.
Figure 6:
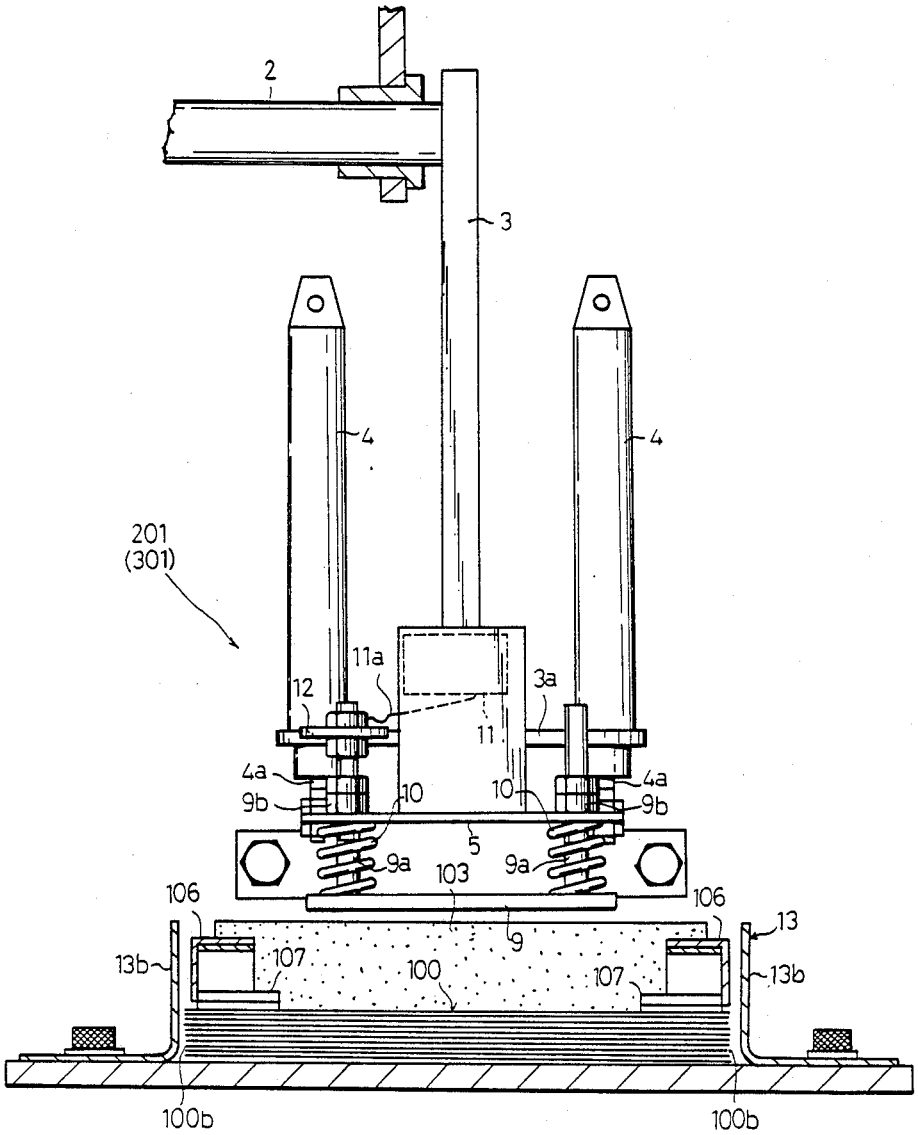
FIG. 6 is a cross-sectional view taken on line VI—VI of FIG. 4.

A horizontally extending rotary shaft 2 is held to the front side of the frame 1 of the machine. As shown in FIGS. 4 and 6, an arm (mounting member) 3 has its base end fixed to the rear end of the shaft 2. A support plate 3*a* is rigidly fixed to the front end of the arm 3. Two similar air cylinders 4 are mounted on the support plate 3*a* on opposite sides of the arm 3. The cylinders 4 have piston rods 4*a* which can move back and forth along the arm 3.

Figure 12:
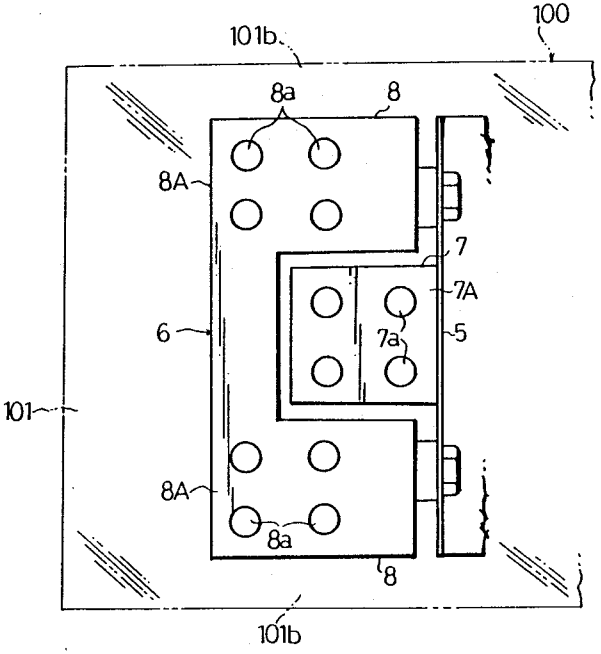
FIG. 12 is a fragmentary enlarged view of the attracting surface of the bag-attracting portion of the bag supply device shown in FIGS. 7–9.

A mounting plate 5 is securely fixed to the front ends f the piston rods 4*a*. A first bag-attracting portion 6 is fixed to one side of the mounting plate 5. As shown in FIG. 12, this attracting portion 6 consists of a central attracting section 7 for opening a bag and front and rear attracting sections 8 for supplying the bag. The attracting sections 8 are disposed on opposite sides of the central attracting section 7. The attracting sections 7 and 8 have attracting surfaces 7A and 8A, respectively, which extend perpendicularly to the direction in which the piston rods 4*a* move. The attracting surface 7A is provided with a plurality of suction ports 7*a* connected to an air suction device VV2 (see FIG. 49). Each of the other attracting surfaces 8A is provided with a plurality of suction ports 8*a* connected to another air suction device VV1 (see FIG. 49).

Figure 7:
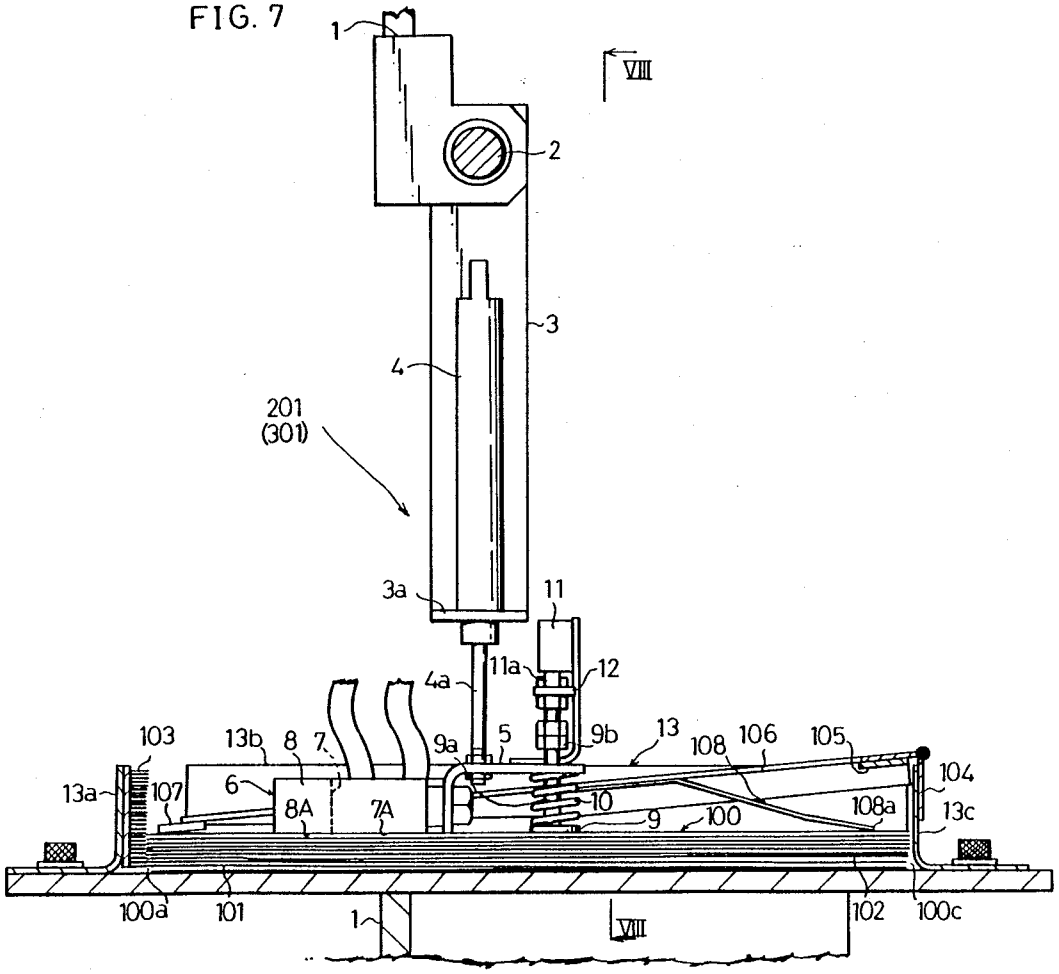
FIG. 7 is a fragmentary enlarged front elevation of the bag supply device, and in which a bag is being supplied.
Figure 8:
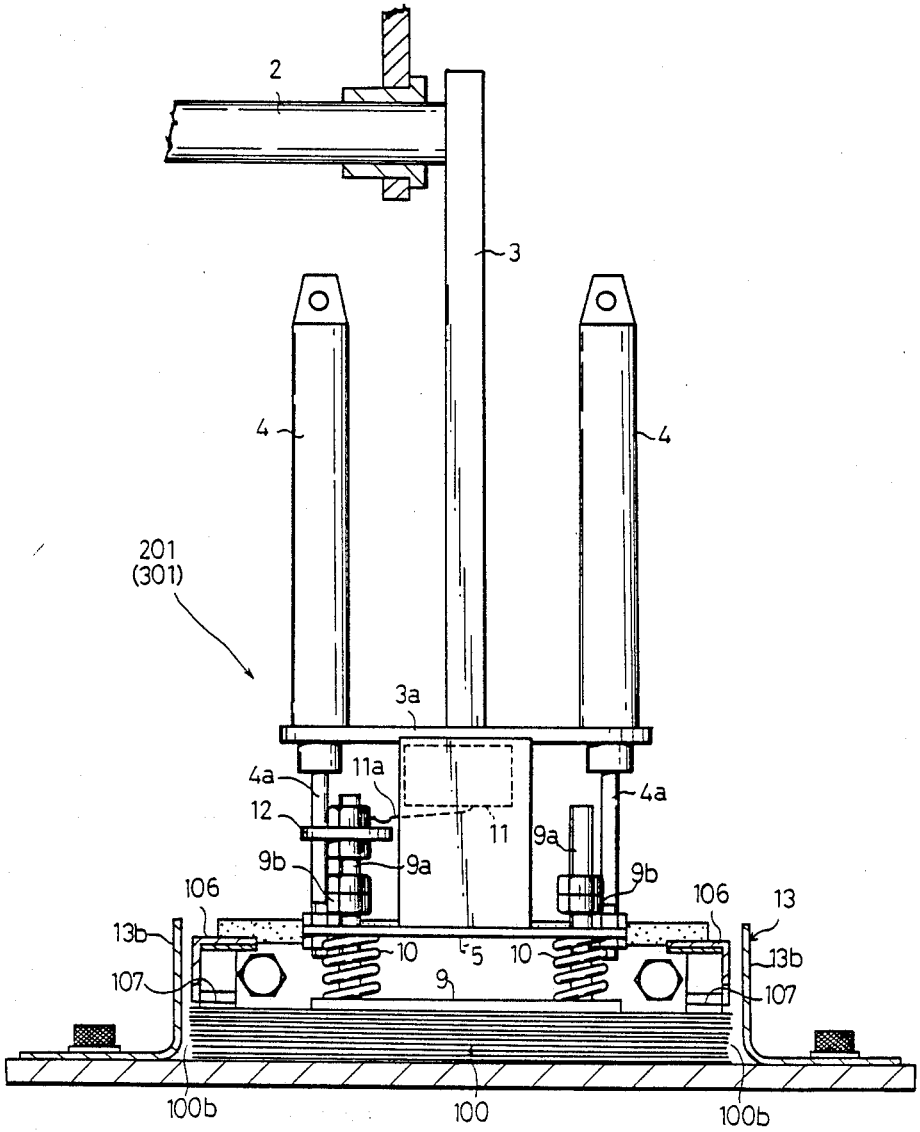
FIG. 8 is a cross-sectional view taken on line VIII—VIII of FIG. 7.

A presser plate 9 is disposed at the side of the first bag-attracting portion 6 on the other side of the mounting plate 5. Threaded rods 9*a* are firmly attached to the presser plate 9 and disposed on opposite sides. The rods 9*a* are movably passed through the mounting plate 5. Stop nuts 9*b* which are anchored to the mounting plate 5 are screwed to the rods 9*a*. A compressed coil spring 10 is wound around each rod 9*a* between the mounting plate 5 and the presser plate 9 to force the presser plate 9 in the direction of the piston rod 4*a*. The resilient force applied to the presser plate 9 by each coiled spring 10 can be adjusted by shifting the position of the corresponding stop nut 9*b*. The presser plate 9 forwardly protrudes always slightly beyond the attracting surfaces 7A and 8A of the first bag-attracting portion 6. A limit switch 11 having an actuation lever 11*a* is mounted to the mounting plate 5. As shown in FIGS. 7 and 8, when the presser plate 9 moves against the Pushing force of the coiled springs 10, an actuation plate 12 fixed to the corresponding threaded rod 9*a* pushes the lever 11*a* of the switch 11.

A case 13 for receiving bags is disposed below the rotary shaft 2 on the front side of the frame 1. This case 13 is placed horizontally and has an opening on its upper side. The case 13 comprises a left wall portion 13*a* attached immovably, front and rear wall portions 13*b* and a right side wall portions 13*c* attached adjustably. A member 103 having bristles is stuck to the inner surface of the left wall portion 13*a*. Resinous bags 100 are stacked on each other within the case 13 in such a way that the left fringes 100*a* of the openings 101 of the bags 100 face the bristles extending from the member 103 on the left wall portion 13*a*. The positions of the front and rear wall portions 13*b* and the position of the right wall portion 13*c* can be adjusted according to the size of the bags 100.

A mounting plate 105 is supported on the right wall portion 13*c* of the case 13 via a hinge 104. Tiltable rods 106 have base ends fixed to the front and rear ends, respectively, of the mounting plate 105. The tiltable rods 106 extend along the inner surfaces of the front and rear wall portions 13*b* to the vicinities of the inner surface of the left wall portion 13*a* inside the front and rear wall portions 13*b*. First support portions 107 are mounted to the front ends of the tiltable rods 106. Leaf springs 108 have base ends fixed to the intermediate portions of the rods 106. The leaf springs 108 extend under the tiltable rods 106 to the vinicities of the right wall portion 13*c*. The front end portions of the springs 108 act as second support portions 108*a*. The first support portions 107 cause the both corner portions between the left fringe 100*a* of the opening 101 of each bag 100 and the front and rear fringes 100*b* to be pressed downward by the weight of the tiltable rods 106 at the position of the opening 101. The second support portions 108*a* cause the both corner portions between the right fringe 100*c* and the front and rear fringes 100*b* to be pressed by the resilient leaf springs 108 at the position of the bottom 102 of each bag 100.

Figure 13:
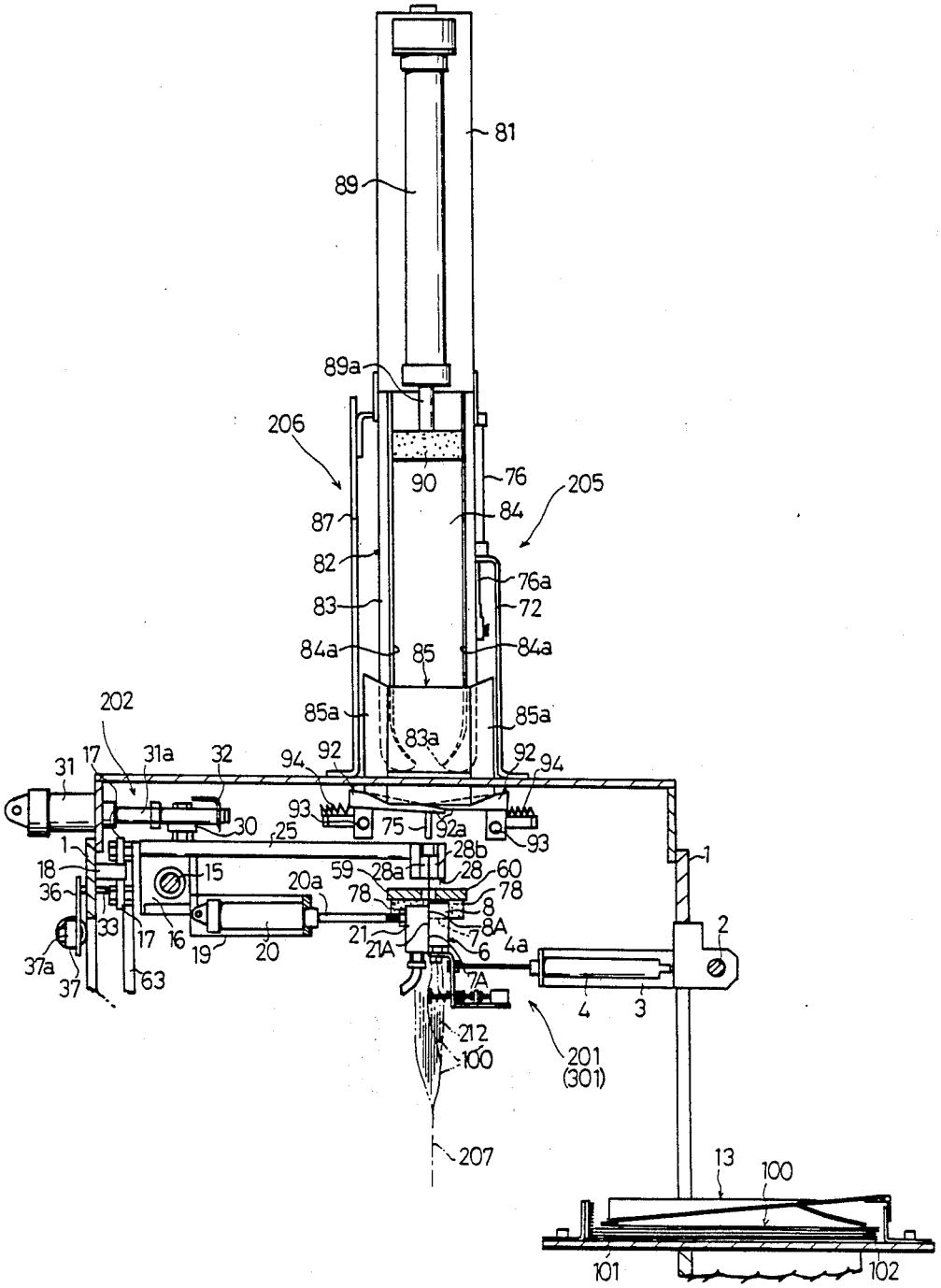
FIG. 13 is a partially sectional view of the bagging machine shown in FIG. 1, for showing the manner in which a bag is opened, an article is put into it, and the opening of the bag is sealed, all at the same time.

The bag supply device 201 is constructed as described above. When the arm 3 is in its bag supply position 301, it is placed vertically as shown in FIGS. 2, 4, 6–11. Under this condition, the first bag-attracting portion 6 is located above the case 13 and faces the opening 101 of each bag 100. Similarly, the presser plate 9 is located above the bag 100 at the right of the first bag-attracting portion 6. The bag supply device 201 reciprocates between the bag supply position 301 and a bag opening position 302, to which the arm 3 has rotated to the left through 90° together with the rotary shaft 2 from the supply position 301 and is placed horizontally as shown in FIG. 13.

A bag-opening device 202 acting to open the opening of each bag is disposed at the left of the front portion of the bagging machine as shown in FIGS. 1, 2, 3, and 13. This opening device 202 is now described in detail. A guide shaft 15 is held so as to extend horizontally between the front and rear sides of the frame 1. As shown in FIG. 14, a pair of sliders 16 is fitted on the shaft 15 at the front end of the shaft 15 so as to be axially movable. As shown in FIG. 15, two similar vertically spaced guide rollers 17 are mounted to the left sides of the sliders 16. A pair of guide rails 18 is rigidly fixed to the left side of the frame 1 and held between the guide rollers 17. Under this condition, the rollers 17 can roll back and forth.

A bracket 19 is rigidly mounted to the right side of the rear slider 16, and an air cylinder 20 is firmly fixed to the bracket 19. The cylinder 20 has a piston rod 20*a* that is movable right and left. A second bag-attracting portion 21 for opening bags is fixed to the front end of the piston rod 20*a*. A guide rod 22 that is rigidly fixed to the second attracting portion 21 extends through the bracket 19 so as to be movable relative to the bracket. The second attracting portion 21 has an attracting surface 21A at its right side, the surface 21A being perpendicular to the direction of movement of the piston rod 20*a*. The attracting surface 21A is provided with a plurality of suction ports 21*a* (see FIG. 26) connected to the air suction device VV2 (see FIG. 49), which also serves to operate the central attracting section 7 of the first bag-attracting portion 6. When the first bag-attracting portion 6 is in the bag opening position 302, the attracting surface 21A faces the attracting surface 7A of the central attracting section 7, as shown in FIGS. 13 and 17(*b*).

A support plate 23 is mounted on the sliders 16 and protrudes to the right. Two similar levers 24 have their central portions held horizontally rotatably to the front portion of the support plate 23 by shafts 24*a*. Links 25 and 26 are rotatably held to opposite ends of the levers 24 on opposite sides of the support plate 23 by shafts 25*a* and 26*a*, respectively. Thus, parallel link mechanisms having four joints are formed by the support plate 23, the levers 24, the links 25, 26 between the shafts 24*a* and 25*a* and between the shafts 24*a* and 26*a*. Clamping portions 27*a* and 27*b* are disposed opposite to each other and clamping portions 28*a* and 28*b* are disposed opposite to each other at the right ends of the links 25 and 26. The clamping portions 27*a* and 27*b* constitute a front clamp 27. The clamping portions 28*a* and 28*b* constitute a rear clamp 28. One link 25 is forced to the right by a compressed coil spring 29. The front clamp 27 and the rear clamp 28 are usually closed above the second bag-attracting portion 21 on the front and rear sides of the attracting portion 21. A surface that interconnects the clamps 27 and 28 forms a center 207 about which each bag 100 opens.

Engaging rollers 30 are mounted at the left ends of the links 25. An air cylinder 31 is fixed to the left side of the frame 1, and has a piston rod 31*a* that can move right and left. An engaging plate 32 which is fixed to the front end of the piston rod 31*a* can engage with the right side of the engaging roller 30 on one link 25. When the rod 31 moves backward, the engaging plate 32 pushes the engaging rollers 30 to the left, as shown in FIG. 16, so that one link 25 moves to the left against the resilience of the coil spring 29. As a result, the levers 24 rotate, and the other link 26 shifts to the right, moving the clamps 27 and 28 away from each other. The support plate 23, the lever 24, the links 25, 26, the coil spring 29, the engaging rollers 30, the air cylinder 31, and the engaging plate 32 constitute a mechanism for opening and closing the clamps 27 and 28.

As shown in FIG. 14, a pivot 33 is rotatably held to the left side of the frame 1. A lever 34 has its central portion rigidly fixed to the inner end of the pivot 33. One link 35 is connected between one end of the lever 34 and the left side surface of one slider 16. Another link 35 is connected between the other end of the lever 34 and the left side surface of the other slider 16. A lever 36 is rigidly fixed to the outer end of the pivot 33. An air cylinder 37 having a piston rod 37*a* connected to the lever 36 is mounted to the left side of the frame 1. As shown in FIG. 15, when the piston rod 37*a* moves forward, this movement is transmitted to the sliders 16 via the lever 36, the pivot 33, the lever 34, and the links 35. Thus, the sliders 16 move away from each other. Inversely, when the piston rod 37*a* moves backward, the sliders 16 move toward each other. In this way, the second bag-attracting portion 21, the air cylinder 20, and other components move back and forth. Also, the clamps 27, 28, and some components 23, 24, 25, 26, 29, 30 of the mechanism for opening and closing the clamps reciprocate in such a way that they move toward and away from each other. The pivot 33, the lever 34, the links 35, and the lever 36, and the air cylinder 37 constitute a mechanism for reciprocating the second bag-attracting portion 21 and the clamps 27 and 28.

Figure 3:
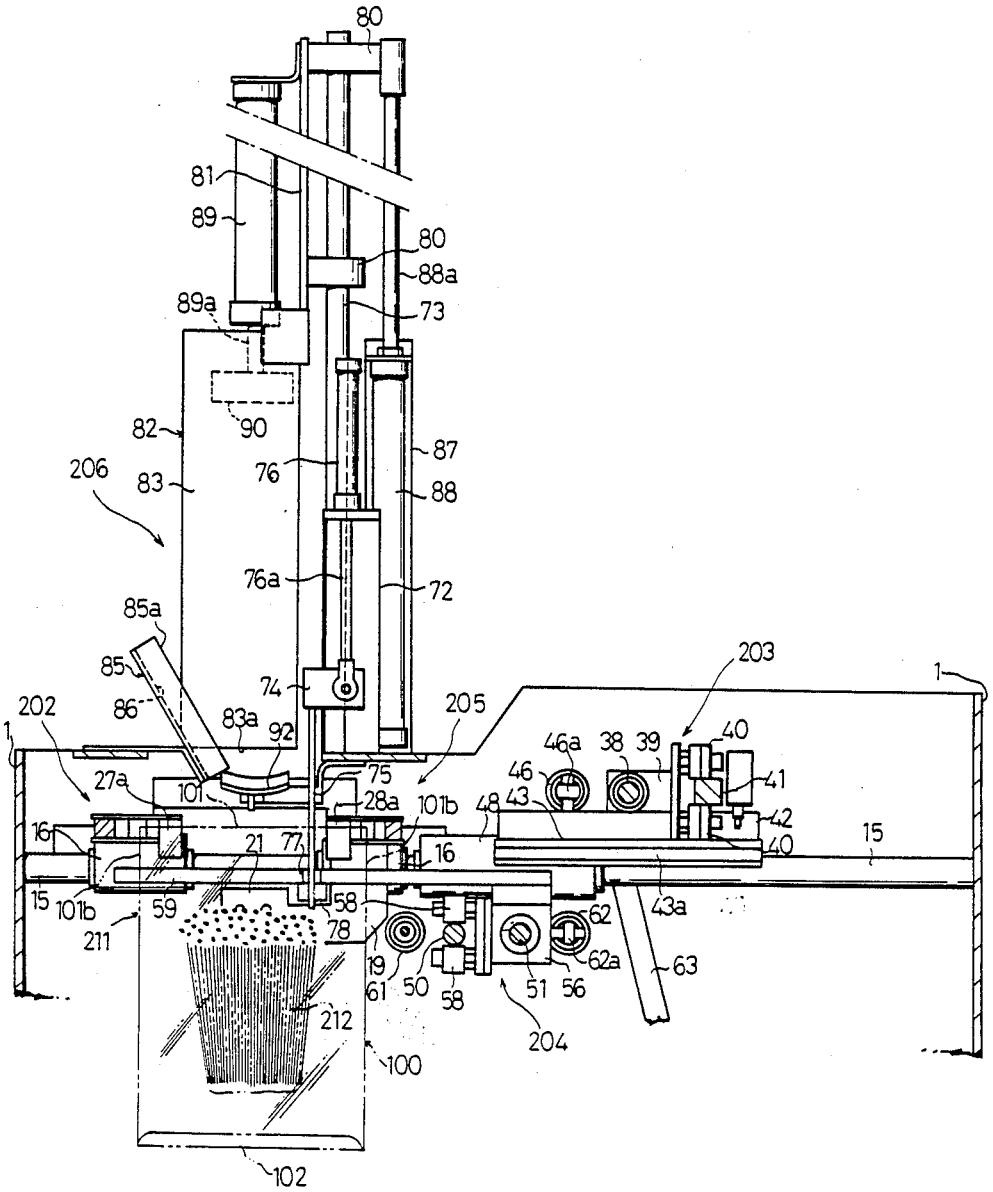
FIG. 3 is a fragmentary cross section taken on line III—III of FIG. 1.

As shown in FIGS. 1, and 3, a bag-sealing device 203 is mounted in the rear of the bagging machine. This sealing device 203 is now described in detail. A guide shaft 38 extends horizontally between the left side and the right side of the frame 1. Two sliders 39 fit on the shaft 38, and are located in a side-by-side relation so as to be axially movable. Two vertically spaced similar guide rollers 40 are mounted to the rear surface of each slider 39. A guide rail 41 extends parallel to the guide shaft 38, and is held to the frame 1. The rollers 40 can roll back and forth along the guide rail 41 while holding the rail 41 between themselves As shown in FIGS. 18 and 19, receptacle portions 42 are firmly fixed to the undersides of the sliders 39. Sealing portions 43 and 44 are fitted in the receptacle portions, respectively, so as to be movable right and left. One sealing portion 43 incorporates a heater (not shown) and this sealing portion 43 acts as a heater. The sealing portions 43 and 44 have holding fringes 43*a* and 44*a* which are disposed opposite to each other. As shown in FIG. 20, the sealing portions 43 and 44 are always urged toward each other by compressed coil springs 45. Air cylinders 46 and 47 are fixed to the frame 1 and disposed in a side-by-side relation. These cylinders 46 and 47 have piston rods 46*a* and 47*a*, respectively, which can move right and left. The piston rod 46*a* of the left cylinder 46 is fixed to the left receptacle portion 42, while the piston rod 47*a* of the right cylinder 47 is attached to the right receptacle portion 42. When the rods 46*a* and 47*a* move backward, the sealing portions 43 and 44 open. Inversely, when the rods 46*a* and 47*a* move forward, the sealing portions 43 and 44 close, and their holding fringes 43*a* and 44*a* bear against each other. Then, these fringes are pressed against each other by the resilient force of the springs 45. The sealing portions 43 and 44 are at the same height as the front clamp 27 and the rear clamp 28 of the opening device 202.

A bag-moving device 204 that reciprocates between the bag-opening device 202 and the bag-sealing device 203 is now described in detail by referring to FIGS. 1 and 3. A slider 48 fits on the rear side of the guide shaft 15 of the opening device 202 so as to be axially movable. As shown in FIG. 21, a bracket 49 is rigidly fixed to the slider 48. Two similar guide shafts 50 and 51 extend horizontally, and are held to the bracket 49. A bracket 52 is firmly fixed to the right ends of the guide shafts 50 and 51. Two similar guide rollers 53 that are vertically spaced from each other are mounted to the bracket 52. A guide rail 54 extends parallel to the guide shaft 15, and is held between the front side and the rear side of the frame 1. The rollers 53 can roll back and forth along the guide rail 54 while holding the rail 54 between themselves Sliders 55 and 56 fit on the guide shafts 50 and 51, respectively, so as to be axially movable. Two similar guide rollers 57 which are vertically spaced from each other are mounted on the rear surface of the slider 55 on the front guide shaft 50. A guide rail portion 51*a* is formed on the rear guide shaft 51. The guide rollers 57 can roll right and left along the guide rail portion 51*a* while holding this rail portion between themselves. Two similar guide rollers 58 which are vertically spaced from each other are mounted on the front surface of the slider 56 on the rear guide shaft 51. A guide rail portion 50*a* is formed on the front guide shaft 50. The guide rollers 58 are capable of rolling back and forth along the guide rail portion 50*a* while holding this rail portion between themselves.

Shutter portions 59 and 60 (holding members) are mounted on the sliders 55 and 56 and protrude forward. These shutter portions 59 and 60 have holding fringes 59*a* and 60*a*, respectively, which face each other. Air cylinders 61 and 62 are fixed to the front side and the rear side, respectively, of the bracket 49 of the slider 48. The cylinders 61 and 62 have piston rods 61*a* and 62*a*, respectively, which can move right and left. The front piston rod 61*a* is fixed to the front slider 55, while the rear piston rod 62*a* is fixed to the rear slider 56. When the front piston rod 61*a* moves forward and the rear piston rod 62*a* moves backward, the shutter portions 59 and 60 open. Inversely, when the front piston rod 61*a* moves backward and the rear piston rod 62 moves forward, the shutter portions 59 and 60 close, so that their respective holding fringes 59*a* and 60*a* abut against each other. The shutter portions 59 and 60 are located below the sealing portions 43 and 44 of the bag-sealing device 203 at a height between the clamps 27, 28 of the opening device 202 and the second bag-attracting portion 21.

As shown in FIG. 22, a lever 63 is so held below the slider 48 on the guide shaft 15 as to be tiltable forwardly and rearwardly. The lever 63 is connected to the slider 48 at its upper end via a link 64. A cam roller 65 is attached to the lower end of the lever 63. A main cam 66 is rotatably held adjacent to the lever 63. The cam roller 65 is pressed against the main cam 66 by a tension coil spring 67. The main cam 66 is connected to a main motor 209 via a chain 66*a*. As the main cam 66 rotates, the lever 63 swings forwardly and rearwardly, causing the slider 48 to reciprocate along the guide shaft 15. Thus, as shown in FIGS. 3 and 47, the shutter portions 59 and 60 reciprocate between a position located below the sealing portions 43 and 44 of the bag sealing device 203 and a position situated below the clamps 27 and 28 of the bag-opening device 202.

As shown in FIGS. 22–24, this lever 63 is connected to the rotary shaft 2 of the aforementioned bag supply device 201 via the link 68, the levers 69*a* and 69*b*, the link 70, and the lever 71. When the rotating arm 3 is in the bag supply position 301, the shutter portions 59 and 60 are located in the bag-opening device 202. When the arm 3 is in the bag opening position 302, the shutter portions 59 and 60 are located in the bag-sealing device 203.

As shown in FIGS. 1, 2, and 3, a device 205 for inserting and withdrawing a bag-deaerating nozzle is located above the bag opening device 202. The device 205 is now described in detail. A support frame 72 is mounted on the frame 1 above the rear clamp 28 of the bag-opening device 202. A guide rod 73 extends upright from the center of the support frame 72. A block 74 fits on the lower end of the guide rod 73 in such a way as to be vertically movable. A suction nozzle 75 extends downwardly from the underside of the block 74, and is connected to an air suction apparatus VV3 (see FIG. 49). An air cylinder 76 is fixed to the right of the support frame 72, and has a piston rod 76*a* capable of being vertically movable. The lower end of the rod 76*a* is connected to the block 74.

As shown in FIGS. 21, 41–46, the holding fringes 59*a* and 60*a* of the shutter portions 59 and 60 of the bag-moving device 204 are provided with notches 77 which are disposed opposite to each other. Resilient members 78 are mounted on the undersides of the shutter portions 59 and 60, corresponding to the notches 77. When the shutter portions 59 and 60 are closed, the resilient members 78 bear against each other, plugging up a space 79 formed between the notches 77. When the shutter portions 59 and 60 are located below the clamps 27 and 28 of the bag-opening device 202, the notch 77 is at the side of the rear clamp 28. The suction nozzle 75 is located just above the central position between the notches 77. As the piston rod 76*a* of the air cylinder 76 moves forward, the nozzle 75 is lowered below the shutter portions 59 and 60.

As shown in FIGS. 1, 2 and 3, an article supply device 206 is located above the bag-opening device 202. This supply device 206 is now described in detail. Two similar blocks 80 which are vertically spaced from each other fit on the guide rod 73 of the device 205 for inserting and withdrawing the deaerating nozzle above the clamps 27, 28 of the opening device 202 so as to be vertically movable. A mounting plate 81 is fixed to the front surface of the blocks 80. An article supply cylinder 82 has an upper end portion fixed to the front surface of the lower end of the mounting plate 81. The cylinder 82 has a flexible cylindrical portion 83 which is shaped like a recess in cross section. The cylindrical portion 83 has a dropping port 83*a*. A slot 84 extends from the dropping port 83*a* to the upper end of the front surface of the cylindrical portion 83. The opposite ends 84*a* of the slot 84 can be bent right and left so as to move toward and away from each other.

A guide member 85 is mounted on the frame 1 in front of the article supply cylinder 82, corresponding to the opposite ends 84*a* of the flexible cylindrical portion 83. The guide member 85 has left and right side portions 85*a* which are bent toward the article supply cylinder 82 to form a cam surface 86 between them. The cam surface 86 is inclined to the direction of vertical movement of the article supply cylinder 82 so that the cam surface 86 may tilt downward as it approaches the cylinder 82. The opposite fringes 84*a* of the cylindrical portion 83 can abut against the cam surface 86.

A support frame 87 is mounted on the frame 1 adjacent to the support frame 72 of the device 205 for inserting and withdrawing the deaerating nozzle. An air cylinder 88 having a piston rod 88*a* capable of being vertically movable is fixed to the support frame 87. The upper end of the piston 88*a* is connected to the upper block 80 on the mounting plate 81.

An air cylinder 89 is mounted on the mounting plate 81, and has a piston rod 89*a* that is inserted in the upper portion of the article supply cylinder 82. The rod 89*a* can vertically move. A resilient article-holding member 90 is mounted to the lower end of the rod 89*a*.

Two similar tongues 92 which are disposed in a side-by-side relation are located below the dropping port 83*a* of the flexible cylindrical portion 83. The tongues 92 are held by a shaft 93 so as to be vertically rotatable, and are forced upward by tension coil springs 94. The front ends 92*a* of the tongues 92 are opposite to each other below the dropping port 83*a*. As the supply cylinder 82 drops, the fringe of the dropping port 83*a* can abut against the tongues 92. The electrical configuration of the bagging machine constructed as described thus far is described below.

Referring to FIG. 49, a microcomputer 95 comprises a central processing unit (CPU) 96, a program memory 97, and a working memory 98. The program memory 97 consists of a read-only memory. The working memory 98 consists of a random access memory (RAM). The microcomputer 95 is incorporated in a control box (not shown) mounted on the bagging machine. The CPU 96 operates according to the control program stored in the program memory 97.

Referring still to FIG. 49, a main switch 210 is used to start a cycle. A limit switch LS0 is used to stop the cycle. Limit switches LS1 and LS1' and a limit switch 11 for the bag supply device 201 are employed to control the air cylinder 4 (SV1) of the bag supply device 201. A limit switch LS2 is installed to control the air cylinder 31 (SV2) of the bag-opening device 202. A limit switch LS3 is installed to control the air cylinder 37 (SV3) of the device 202. A limit switch LS4 is provided to control the air cylinder 20 (SV4) of the device 202. A limit switch LS5 is installed to control the air cylinders 61 and 62 (SV5 and SV5') of the bag-moving device 204. A limit switch LS6 is installed to control the air cylinders 46 and 47 (SV6 and SV6') of the bag-sealing device 203. A limit switch LS7 is used to control the air cylinder 88 (SV7) of the article supply device 206. A limit switch LS8 is provided to control the air cylinder 89 (SV8) of the device 206. A limit switch LS9 is employed to control the air cylinder 76 (SV9) of the device 205 for inserting and withdrawing the deaerating nozzle. A limit switch LS11 is installed to control the air suction apparatus VV1 of the bag supply device 201. A limit switch LS12 is installed to control the air suction apparatus VV2 for the bag supply device 201 and for the bag-opening device 202. A limit switch LS13 is installed to control the air suction apparatus VV3 for the device 205 for inserting and withdrawing the deaerating nozzle. These switches are connected to the input terminals of the CPU 96. The limit switches LS0, LS1, LS1', LS2, LS3, LS4, LS5, LS6, LS7, LS8, LS9, LS11, LS12, and LS13 are installed in a side-by-side relation and shown as a limit switch group LS in FIG. 22. These switches are actuated by a group of cams 99 which are driven by the main motor 209 via the chain 66*a*.

The operation of the bagging machine is described below in detail. In this example, simultaneously with the supply of a bag, another bag is deaerated. The opening of the first bag is sealed when the opening of the second bag is opened and an article is put into it. Accordingly, two bags are processed concurrently, but for the sake of simplicity the operations for only one bag are described below.

In the condition shown in FIGS. 2, 4, 6, the rotary arm 3 of the bag supply device 201 is in the bag supply position 301. The piston rod 4*a* of the air cylinder 4 (SV1) has retracted, and the first bag-attracting portion 6 has been elevated. Only the opposite attracting sections 8 are attracted by the air suction device VV1.

Figure 9:
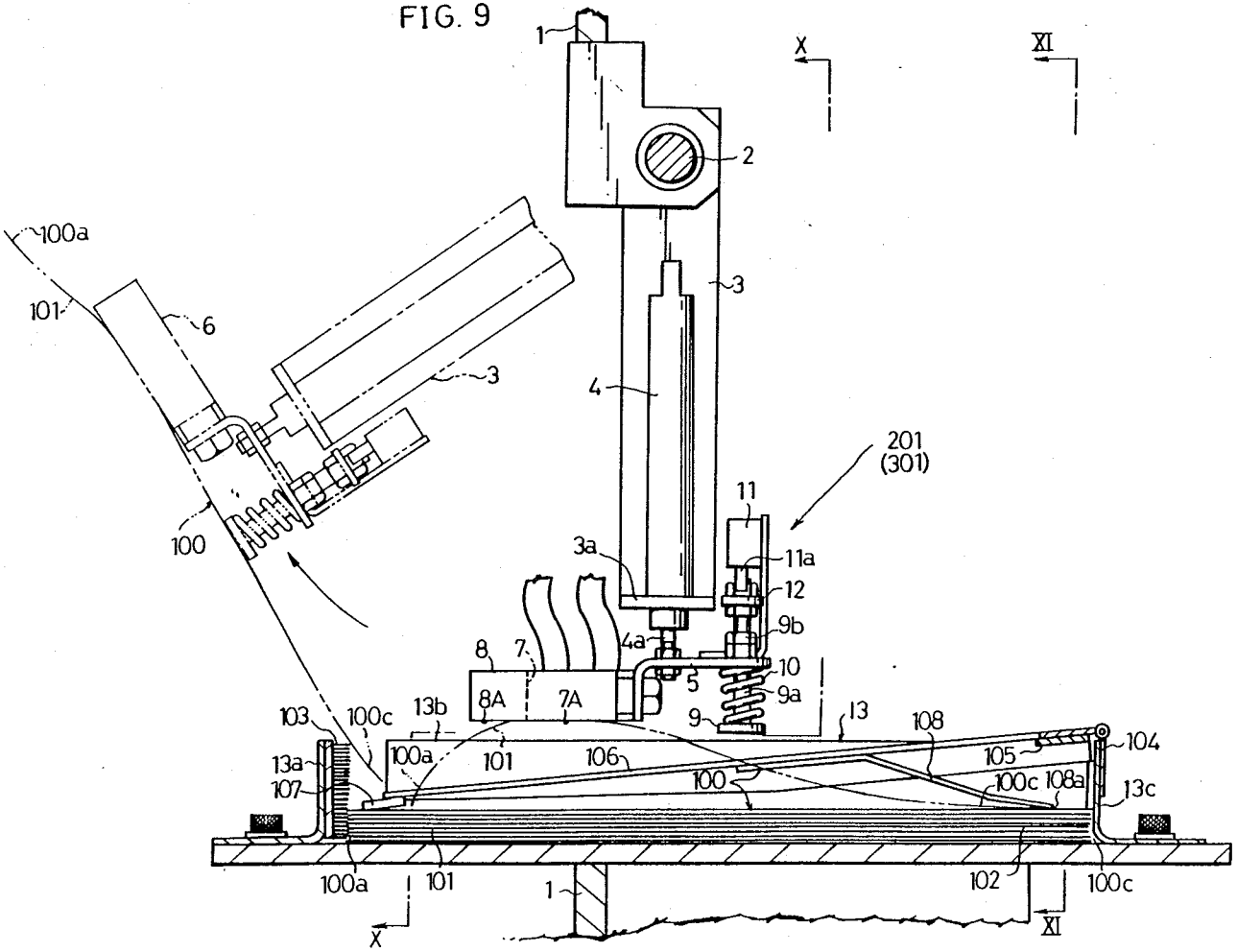
FIG. 9 is a view similar to FIG. 7, but in which a bag has been already attracted.
Figure 11:
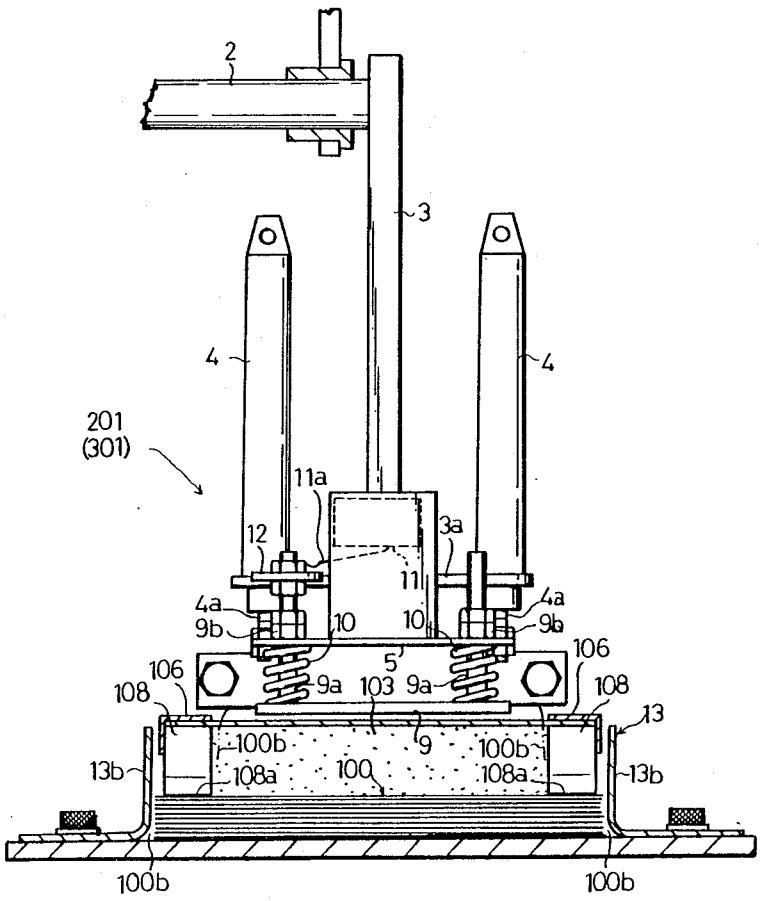
FIG. 11 is a cross-sectional view taken on line of FIG. 9.
Figure 10:
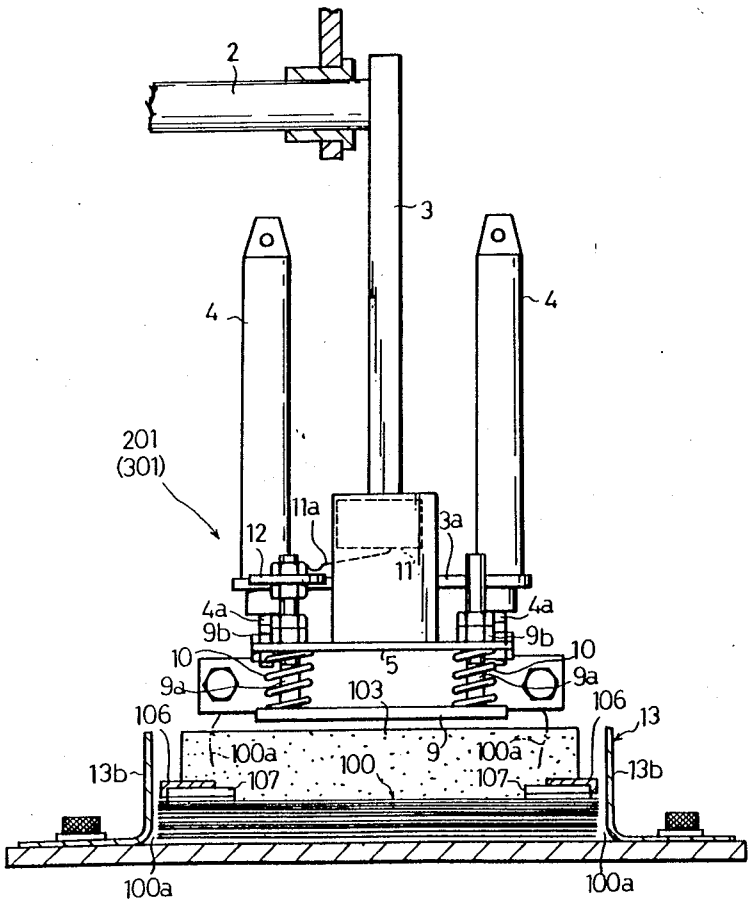
FIG. 10 is a cross-sectional view taken on line XI—XI of FIG. 9.

Under this condition, when the limit switch LS1 is closed, the piston rod 4*a* of the air cylinder 4 (SV1) moves forward, and the presser plate 9 and the first bag-attracting portion 6 are lowered. Then, the presser plate 9 bears against the uppermost bag 100 inside the case 13, as shown in FIGS. 7 and 8. The plate 9 is raised against the action of the compressed coil spring 10. Next, the first bag-attracting portion 6 comes into contact with the opening 101 of the bag 100. The front and rear sides 101*b* of the opening 101 are attracted by the suction ports 8*a* of the opposed attracting sections 8, as shown in FIG. 12, so that the bag 100 is attracted to the first bag-attracting portion 6. The presser plate 9 and the first bag-attracting plate 6 are pressed against the uppermost bag 100. Subsequently, the actuation plate 12 of the presser plate 9 actuates the limit switch 11. Then, as shown in FIG. 9, the piston rod 4*a* of the air cylinder 4 (SV1) retracts, elevating the presser plate 9 and the bag-attracting plate 6.

If the second and the following bags 100 are stuck to the uppermost bag 100 at the beginning of this upward movement, then the second and the following bags 100 follow the raised uppermost bag 100. At this time, the left fringes 100*a* of the first, second, and following bags 100 come into contact with the bristles 103, which then enter between these bags to separate them even if the left fringes 100*a* of the bags adhere to each other. Then, the first bag 100 is raised further, and the second and following bags 100 are about to be raised simultaneously. However, each bag 100 is pressed down by the first and second support portions, 107 and 108*a*. This pressing force exceeds the adhereing force exerted between the first bag 100 and the second bag 100. As a result, only the first bag 100 is raised by the bag-attracting portion 6, and the second bag 100 is separated from the first one. Then, only the left fringe 100*a* and the front and rear side fringes 100*b* of the opening 101 of the first bag 100 come out of the first support portion 107. Thereafter, only the right fringe 100*c* and the front and rear fringes 100*b* of the bottom 102 of the first bag 100 come out of the second support portion 108*a*. After the side fringes 100*a*, 100*b*, 100*c* come out of the support portions 107 and 108*a*, the side fringes 100*a*, 100*b*, and 100*c* of the second bag 100 are pressed down by the support portions 107 and 108*a*. Finally, the bag-attracting portion 6 comes to a halt under the condition shown in FIGS. 9–11. Meanwhile, the presser plate 9 is returned downward by the resilience of the compressed coil spring 10. The actuation plate 12 then disengages from the actuation lever 11*a* of the limit switch 11.

This condition is maintained for a short time. Then, the rotary arm 3 of the bag supply device 201 begins to rotate from the bag supply position 301 toward the bag supply position 302, as indicated by the imaginary line in FIG. 9. The limit switch LS1 is kept closed to permit the piston rod 4*a* of the air cylinder 4 (SV1) to advance until the arm 3 reaches the bag opening position 302. As shown in FIG. 13, the bag 100 is supplied to the bag-opening device 202. Also, the limit switch LS12 is closed to allow the air suction device VV2 to operate also the central attracting section 7 of the first bag-attracting portion 6. The central portion of the opening 101 of the bag is attracted to the suction port 7*a*.

Before the arm 3 in the bag-opening device 202 reaches the bag opening position 302, the limit switch LS4 is closed to move the piston rod 20*a* of the air cylinder 20 (SV4) forwardly. As shown in FIG. 17(*a*), the second bag-attracting portion 21 advances and moves toward the first bag-attracting portion 6. In this state, the clamps 27 and 28 are remotest from each other and open. The left and right side surfaces 101*a* of the opening 101 of the bag 100 are held between the second bag-attracting portion 21 and the first bag-attracting portion 6. The limit switch LS12 is closed to cause the air suction apparatus VV2 to operate the second bag-attracting portion 21. The central portion of the opening 101 of the bag 100 is attracted to the suction port 21*a* of the second bag-attracting portion 21.

Immediately thereafter, the limit switch LS2 is closed to move the piston rod 31*a* of the air cylinder 31 (SV2) forward. Then, the clamps 27 and 28 are closed. The limit switch LS3 is closed to retract the piston rod 37*a* of the air cylinder 37 (SV3). As the clamps 27 and 28 approaches each other, as shown in FIG. 17(*b*), one pair of clamp portions 27*a* and 27*b* of the clamp 27 and one pair of clamp portions 28*a* and 28*b* of the clamp 28 move obliquely inward, and hold the front and rear sides 101*b* of the opening 101 of the bag 100 between themselves inside the remotest position 208. The second bag-attracting portion 21 shifts forward from the central attracting section 7 of the first bag-attracting portion 6 to stagger the left and right side surfaces 101*a* of the opening 101 of the bag 100.

Subsequently, the clamps 27 and 28 move toward each other, as shown in FIG. 17(*c*), and the second bag-attracting portion 21 similarly shifts to slacken the opening 101 of the bag 100, for permitting the bag to open.

Then, the limit switch LS11 is closed to stop the operation of the air suction apparatus VV1. Thus, only the suction of the opposed attracting sections 8 of the first bag-attracting portion 6 is stopped. The limit switches LS1' and LS4 are closed to retract the piston rod 4*a* of the air cylinder 4 (SV1) and the piston rod 20*a* of the air cylinder 20 (SV4). As shown in FIG. 17(*d*), the first bag-attracting portion 6 and the second bag-attracting portion 21 retract. Then, the central attracting section 7 and the second bag-attracting portion 21 open the left and right side surfaces 101*a* of the opening 101 of the bag 100. Immediately thereafter, the limit switch LS0 for stopping cycle is closed to stop the main motor 209, the main cam 66, and other components.

Under the condition shown in FIGS. 1(*a*)–3, the piston rod 88*a* of the air cylinder 88 has advanced, and the article supply cylinder 82 is at a high position. Both fringes 84*a* of the flexible cylindrical portion 83 of the cylinder 82 are expanded. The lower ends of the fringes 84*a* are in contact with the cam surface 86 on the guide member 85 and bent slightly inward. The tongues 92 are closed by the resilience of the tension coil spring 94.

When an article 212 such as mushroom is supplied into the article supply cylinder 82 as shown in FIGS. 25 and 26, the article 212 is stopped by the tongues 92. Only the lower end of the article 212 is exposed through the dropping port 83*a* of the cylindrical portion 83. After checking this state, the operator closes the main switch 210. Then, the main motor 209 is again operated. Also, the main cam 66 and other components are driven.

Thereafter, the limit switch LS7 is closed to lower the piston rod 88*a* of the air cylinder 88 (SV7) of the article supply device 206. As shown in FIGS. 28 and 29, the article supply cylinder 82 then drops, and the limit switch LS9 is closed to lower the piston rod 76*a* of the air cylinder 76 (SV9) of the device 205 for inserting and withdrawing the deaerating nozzle. This lowers the suction nozzle 75 to permit the dropping port 83*a* of the cylinder 82 to depress the tongues 92, for opening them. Then, the tongues 92 expand the opening 101 of the bag 100. Both fringes 84*a* of the flexible cylindrical portion 83 move toward each other along the cam surface 86 on the guide member 85 against their resilience. The cylindrical portion 83 is gradually compressed from its lower end. The article 212 is compressed within the cylindrical portion 83, and then the article is inserted into the bag together with the cylindrical portion 83 through the opening 101 of the bag 100. Meanwhile, the suction nozzle 75 is inserted into the bag 100 through the opening 101. As the nozzle moves downward, the air cylinder 89 and the article-holding member 90 also drop.

Figure 31:
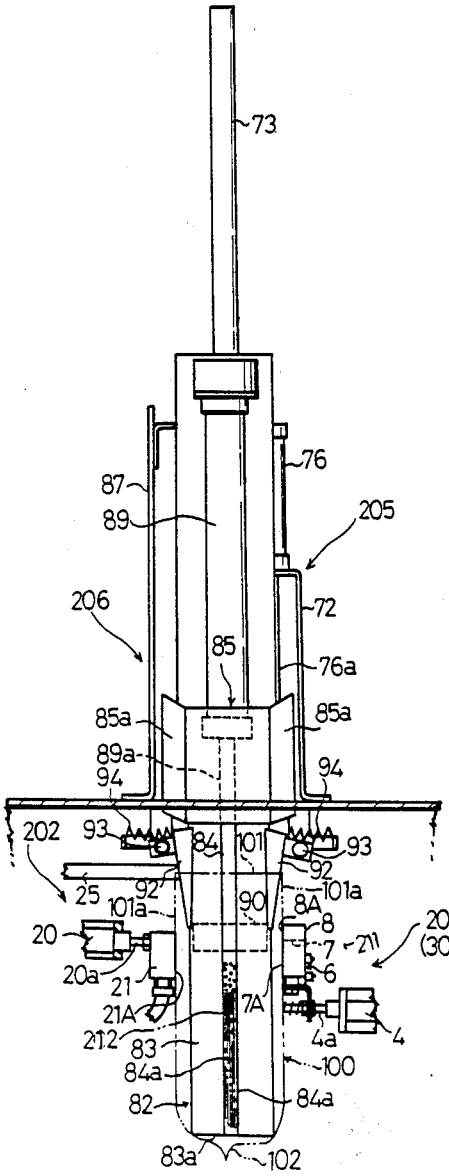

Immediately thereafter, the limit switch LS8 is closed to lower the piston rod 89*a* of the air cylinder 89 (SV8) of the device 206. As shown in FIG. 31, the article-holding member 90 also descends. As shown in FIGS. 37–40, the lowest position S is lower than the shutter portions 59 and 60 of the bag-moving device 204.

Figure 32:
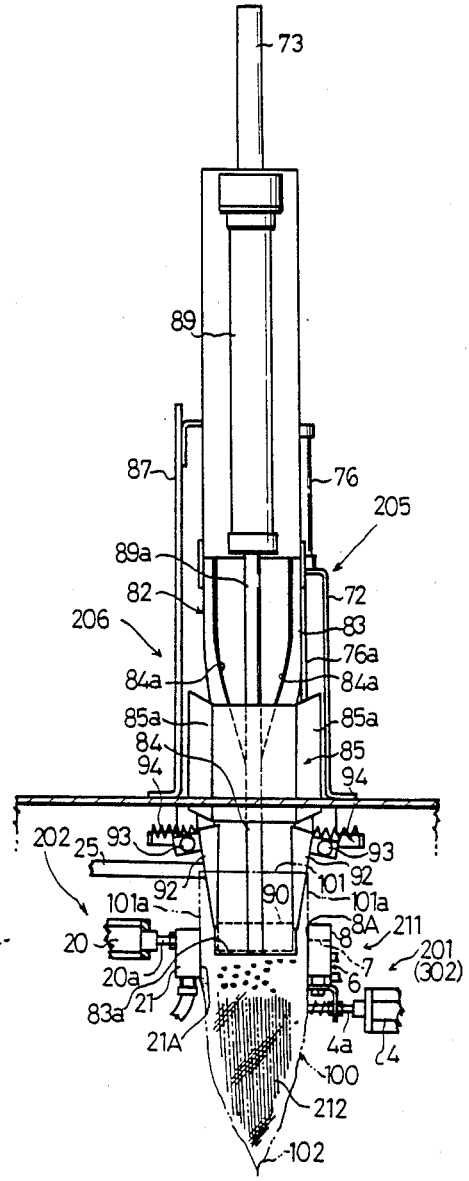

Then, the limit switch LS7 is closed to elevate the piston rod 88*a* of the air cylinder 88 (SV7) to raise the article supply cylinder 82, as shown in FIG. 32. The article-holding member 90 comes to a halt and depresses the article 212. The upward movement of the cylinder 82 causes the article 212 to come out of the flexible cylindrical portion 83 that is being compressed. After the dropping port 83*a* reaches the article-holding member 90, the article-holding member 90 begins to follow the ascending article supply cylinder 82.

Figure 33:
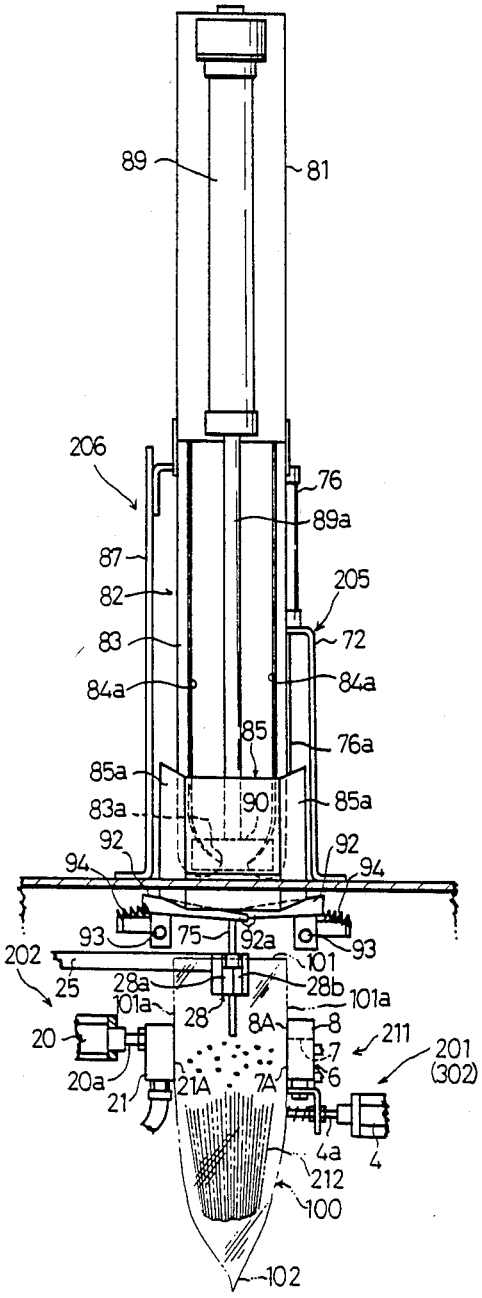
Figure 34:
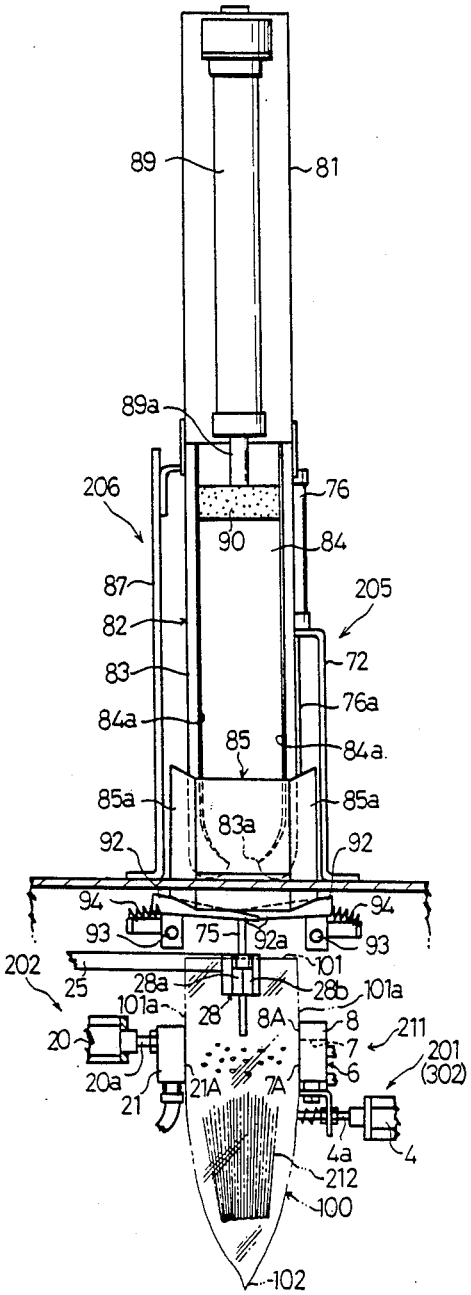

Thereafter, as shown in FIG. 33, the lower ends of both fringes 84*a* of the flexible cylindrical portion 83 reach the cam surface 86 on the guide member 85, after which the article supply cylinder 82 stops ascending. The resilience of both fringes 84*a* moves themselves away from each other along the cam surface 86*a*. Thus, the compression of the cylindrical portion 83 is released gradually. As a result, only the article 212 remains in the bag 100. Then, the limit switch LS8 is closed to elevate the piston rod 89a of the air cylinder 89 (SV8). As shown in FIG. 34, the article-holding member 90 is also elevated Meanwhile, the suction nozzle 75 is retained lowered. As shown in FIGS. 35 and 36, the central attracting section 7 of the first bag-attracting portion 6 and the second bag-attracting portion 21 have already stopped sucking, because the limit switch LS12 was closed to stop the operation of the air suction apparatus VV2. The opening 101 of the bag 100 is suspended only by the clamps 27 and 28.

Then, the limit switch LS5 is closed to advance the piston rod 61a of the air cylinder 61 (SV5) of the bag moving device 204. At the same time, the piston rod 62a of the air cylinder 62 (SV5') is retracted, opening the shutter portions 59 and 60. Thereafter, the shutter portions 59 and 60 begin to move from the bag-sealing device 203 toward the bag-opening device 202. At the same time, the rotary arm 3 of the bag supply device 201 starts to rotate from the bag opening position 302 toward the bag supply position 301.

Before the arm 3 reaches the bag supply position 301, the limit switch LS3 is closed to advance the piston rod 37a of the air cylinder 37 (SV3) of the bag-opening device 202. As shown in FIGS. 37, 38, and 17(*e*), the clamps 27 and 28 move away from each other to close the opening 101 of the bag 100, until they reach the remotest positions 208. In this way, the opening 101 is made taut. Simultaneously, the second bag-attracting portion 21 moves backward so as to face the central attracting section 7 of the first bag-attracting portion 6. Also, the limit switch LS5 is closed to retract the piston rod 61a of the air cylinder 61 (SV5) of the bag-moving device 204. The piston rod 62a of the air cylinder 62 (SV5') advances to close the shutter portions 59 and 60 in the bag-opening device 202, as shown in FIGS. 39 and 40. Then, the opening 101 of the bag 100 is held between the holding fringes 59a and 60a of the shutter portions 59 and 60. As shown in FIGS. 41–43, the suction nozzle 75 enters between the notches 77 in the shutter portions 59 and 60 and is held between the resilient members 78. In this state, the space 79 between the notches 77 is plugged up. Accordingly, the opening 101 of the bag 100 is sealed.

When the arm 3 reaches the bag supply position 301, the limit switch LS13 is closed to operate the air suction apparatus VV3, so that the suction nozzle 75 begins to suck. The result is that the inside of the bag 100 is evacuated almost to a vacuum. Also, the limit switch LS11 is closed to operate the air suction apparatus VV1, for attracting the opposed attracting sections 8 of the first attracting portion 6.

Before the arm 3 begins to turn from the bag supply position 301 toward the bag opening position 302, the limit switch LS9 is closed to elevate the piston rod 76a of the air cylinder 76 (SV9) of the device 205 for inserting and withdrawing the deaerating nozzle. This raises the suction nozzle 75 and, at the same time, the limit switch LS13 is closed to stop the operation of the air suction apparatus VV3. Consequently, the suction through the suction nozzle 75 stops. As shown in FIGS. 44,45 and 46, the upward movement of the nozzle 75 takes it out of the notches 77 in the shutter portions 59 and 60. At this time, the resilient members 78 rapidly close, plugging up the space 79 between the notches 77. Hence, there is no possibility of leakage of air into the bag 100. Also, the limit switch LS2 is closed to retract the piston rod 31a of the air cylinder 31 (SV2) to open the clamps 27 and 28 of the bag-opening device 202. In this state, the opening 101 of the bag 100 is suspended only by the shutter portions 59 and 60.

Before the arm 3 arrives at the bag opening position 302, the shutter portions 59 and 60 of the bag-moving device 204 move rearward and arrive in the bag-sealing device 203, closing the limit switch LS6. Then, the piston rods 46a and 47a of the air cylinders 46 (SV6) and 47 (SV6'), respectively, of the device 203 move forward. As shown in FIGS. 47 and 48, the sealing portions 43 and 44 close, and the opening of the bag 100 is held between the holding fringes 43a and 44a. This condition persists until the article supply cylinder 82 and the article-holding member 90 rise. During this interval, the opening of the bag 100 is sealed by heat. Subsequently, the limit switch LS6 is closed to retract the piston rods 46a and 47a of the air cylinders 46 (SV6) and 47 (SV6') to open the sealing portions 43 and 44. Then, the shutter portions 59 and 60 open to enable the bag 100 to drop, thus completing the bagging operation.

In the present invention, the supply of one bag 100 and the deaeration of another bag 100 are effected simultaneously. Also, the opening 101 of one bag 100 is opened, the article 212 is supplied, and the opening 101 of another bag 100 is sealed, all at the same time. Consequently, the bagging operation using the previous bag 100 and the bagging operation using the following bag 100 are performed simultaneously. The present example can be modified in the manner described below.

(a) In the bag supply device 201, the first bag-attracting portion 6, the presser plate 9, and other components are fixed to the arm 3 to make the case 13 vertically movable.

(b) The bag-sealing device 203 makes use of seal using tape or metal fittings, other than thermal seal.

(c) The second bag-attracting portion 21 of the bag-opening device 202 is made rotatable relative to the piston rod 20a of the air cylinder 20. As the second attracting portion 21 is rotated, it is shifted from the first bag-attracting portion 6 along both side surfaces 101a of each bag 100.

(d) Preserving liquid or gas is introduced through the nozzle 75 of the device 205 for inserting and withdrawing the deaerating nozzle. In this case, the nozzle 75 is made of a double tube. Liquid or gas is admitted through the inner tube. Air is removed from the bag 100 through the outer tube. The outer periphery of this outer tube is in contact with the resilient members 78 and is sealed thereby. This prevents leakage of liquid or gas.

(e) The member 103 having bristles of the bag supply device 201 facilitates separating the left fringes 100a of the openings of bags 100, but this is an auxiliary function. Only the support portions 107 and 108a suffice to separate them and, therefore, the member 103 is not essential to the invention.

(f) The bag supply device 201 have the support portions 107 and 108a, corresponding to the opening 101 and the bottom 102, respectively, of each bag 100. Only the support portion 107 suffices which corresponds to the opening 101 attracted by the first bag-attracting portion 6.

(g) The bag supply device 201 is provided with the support portions 107 and 108a corresponding to the four corners of each bag 100. The device 201 can further include other support portions corresponding to other side fringes 100a, 100b, and 100c of the bag 100. Alternatively, a support portion corresponding to all of the side fringes 100a, 100b, 100c may be provided.

(h) The bag supply device 201 have the support portions 107 and 108*a* on the tiltable rod 106. The four corners inside the case 13 can have spring-forced support portions.

(i) The first bag-attracting portion 6, the presser plate 9, and other components of the bag supply device 201 are mounted on the arm 3. The case 13 that receives bags is rendered movable vertically.

In summary, the novel bagging machine according to the invention comprises the bag supply device 201, the bag-opening device 202, and the bag-sealing device 203. The bag supply device 201 and the bag-opening device 202 are interconnected functionally by the mounting member 3 of the device 201 and the first bag-attracting portion 6. The first attracting portion 6 not only acts to supply bags 100 but also cooperates with the second bag-attracting portion 21 of the device 202 to open bags 100. The bag-opening device 202 and the bag-sealing device 203 are interconnected functionally by the holding members 59 and 60 of the bag-moving device 204. Therefore, the whole bagging machine is made compact. Also, the productivity is enhanced. Because the device 205 for inserting and withdrawing the deaerating nozzle is added, corresponding to the bag-opening device 202. These are interconnected functionally. The article 212 can be preserved by introducing liquid or gas or by deaerating each bag through the device 205.

As many apparently widely different embodiments of the invention may be made without departing from the spirit and scope thereof, it is to be understood that the invention is not limited to the specific embodiments thereof except as defined in the appended claims.

What is claimed is:

1. A bagging machine adapted to open, fill and close a bag, comprising a bag supply means having a mounting member reciprocating between a bag supply position and a bag opening position, and a first bag-attracting portion mounted to the mounting members;

a bag-opening means having a second bag-attracting portion which is substantially facing the first bag-attracting portion when the mounting member of the bag supply means is in the bag opening position and which is movable in a first direction toward and away from the first bag-attracting portion, and means for shifting the second bag-attracting portion in a second direction substantially perpendicular to the first direction relative to the first bag-attracting portion when the second bag-attracting portion is in an abutting position with the first bag-attracting portion so as to hold the bag therebetween and to stagger the right and left side surfaces of an opening of the bag;

bag-filling means for putting selected articles in the bag;

bag-sealing means for closing the bag after opening and filling the bag; and bag-moving means having a pair of openable holding members reciprocating between the bag-opening means and the bag-sealing means, the holding members being capable of closing the bag while holding the opening of the bag therebetween.

2. The bagging machine of claim 1, wherein the mounting member of the bag supply means is an arm capable of rotating about a shaft.

3. The bagging machine of claim 2, wherein the bag supply means and the bag-moving means are connected together, and wherein the holding members are located in the bag-opening means when the arm is in the bag supply position and located in the bag-sealing means when the arm is in the bag opening position.

4. The bagging machine of claim 1, wherein the bag-sealing means has a pair of sealing portions which can open and close, and wherein one of the sealing portions is a heater for sealing the opening of the bag by heat.

5. The bagging machine of claim 1, wherein each of the first and second bag-attracting portions has suction Ports for drawing air from the bag.

6. The bagging machine of claim 1, further including a nozzle-inserting-and-withdrawing means having a nozzle mounted corresponding to the bag-opening means, the nozzle being capable of moving forward and backward in such a way that it can be inserted between the holding members of the bag-moving means.

7. The bagging machine of claim 6, wherein the holding members of the bag-moving means are provided with opposed notches which form a space and between which the nozzle is inserted, and wherein a pair of resilient members is located at positions corresponding to the notches, the resilient members being mounted on the surface that is on the opposite side of the surface facing the nozzle-inserting-and-withdrawing means, the resilient members bearing against each other to plug up the space when the holding members are brought into contact with each other and closed.

8. The bagging machine of claim 1, further including an article supply means having an article supply cylinder and an article-holding member mounted in the cylinder, the article supply cylinder being capable of vertically moving so as to be inserted into or withdrawn from the opening of the bag which is opened by the bag-opening means, the article-holding member being capable of reciprocating axially of the cylinder, and wherein the lowest position that the article-holding member can assume is lower than the position of the holding members of the bag-moving means.

9. The bagging machine of claim 8, wherein the article supply cylinder comprises a flexible cylindrical portion which takes a recessed form in cross section and which has opposite side fringes capable of being deformed so as to move toward and away from each other, the cylindrical portion having a dropping port at its lower end for permitting the article to drop, and wherein the article supply means further includes a guide member having a cam surface which is inclined downward toward the article supply cylinder, the guide member being mounted corresponding to the opposite side fringes of the flexible cylindrical portion, the opposite side fringes moving on the cam surface to compress the flexible cylindrical portion as the article supply cylinder moves downward.

10. The bagging machine of claim 9, wherein two opposed similar tongues are disposed below the dropping port of the flexible cylindrical portion, can rotate upwardly and downwardly, and are always urged upward, and wherein when the article supply cylinder moves downward, the peripheral fringe of the dropping port bears against the tongues, and the tongues expand downwardly to expand the opening of the bag.

11. The bagging machine of claim 1, further including a case for receiving the bag, the case having at least one support means for holding the side fringes of the bag, and wherein the first bag-attracting portion can move toward and away from the case.

12. The bagging machine of claim 11, wherein the support means is a first support portion for holding both corners of one side fringe of the bag.

13. The bagging machine of claim 11, wherein the support means includes a first support portion and a second support portion for holding the corners of the opposite side fringes of the bag.

14. The bagging machine of claim 11, wherein a member having a number of bristles is mounted on the inner side surface of the case which faces the opening of the bag that is disposed in the case while in contact with the member having the bristles.

15. The bagging machine of claim 11, wherein the first bag-attracting portion includes a central attracting section for opening the bag and opposite attracting sections for supplying the bag, the opposite attracting sections being disposed on opposite sides of the central attracting section.

16. The bagging machine of claim 11, wherein the mounting member includes a presser member near the first bag-attracting portion, the presser member being capable of moving in the direction of movement of the first attracting portion, and wherein the presser member resiliently pushes the bag when the first bag-attracting portion attracts the bag inside the case.

17. The bagging machine of claim 16, wherein the mounting member further includes a limit switch for initiating upward movement of the first attracting portion attracting the bag, and wherein the presser member protrudes slightly beyond the first bag-attracting portion toward the bag and bears against the bag before the first bag attracting portion bears against the bag, the presser member moving away from the bag to close the limit switch as the first bag-attracting portion moves toward the bag.

18. The bagging machine of claim 1, wherein the bag-opening means further includes a guide shaft extending perpendicularly to the direction of movement of the second bag-attracting portion and a slider mounted on the guide shaft so as to be movable longitudinally of the guide shaft, and wherein the second bag-attracting portion is mounted to the slider and capable of reciprocating longitudinally of the guide shaft when the bag is opened.

19. The bagging machine of claim 18, wherein the bag-opening means further includes a second slider on the guide shaft, the second slider being similar to the aforementioned slider, each of the sliders having a pair of first links extending in the direction of movement of the second bag-attracting portion, the first links being capable of moving in opposite directions, the front end of each first link having a pair of clamps mounted thereon, the clamps holding the corners of the opening of the bag therebetween.

20. The bagging machine of claim 19, wherein support plates extending in the same direction as the first links are mounted between the first links on the sliders, and wherein a pair of first levers is pivotally mounted to each support plate such that the first levers are rotatable about their centers, the first links being pivotally mounted to both ends of the first levers and capable of moving in opposite directions.

21. The bagging machine of claim 20, wherein the clamps are usually urged in such a direction as to be closed by compressed coil springs which are mounted between the first links so as to expand longitudinally of the first links.

22. The bagging machine of claim 19, wherein two similar second links have their respective one ends pivotally mounted to the sliders, the other ends of the second links being pivotally mounted to the longitudinal ends of second levers, and wherein the sliders can be moved toward and away from each other via the second links and the second levers.

23. The bagging machine of claim 22, wherein the second levers are connected to a driving means via a shaft, and wherein when the driving means is operated, the second levers rotate to move the sliders toward or away from each other.

24. The bagging machine of claim 1, wherein the bag-sealing means further includes a guide shaft and a pair of sliders capable of moving on the guide shaft longitudinally of the guide shaft which extends parallel to the direction of movement of the second bag-attracting portion, and wherein the sealing portions are mounted to the sliders so as to face each other.

25. The bagging machine of claim 24, wherein the bag-sealing means further includes a pair of opposed receptacle portions mounted to the sliders, and wherein the sealing portions are mounted in the receptacle portions so as to be movable in a direction perpendicular to the longitudinal direction of the guide shaft.

26. The bagging machine of claim 1, wherein said bag-moving means includes a first guide shaft extending perpendicularly to the direction of movement of the second bag-attracting portion and a first slider mounted to the first guide shaft so as to be movable longitudinally of the first guide shaft, the first slider reciprocating between the bag-opening means and the bag-sealing means, and wherein said holding members are mounted to the first slider.

27. The bagging machine of claim 26, wherein the bag-moving means further includes a pair of second guide shafts mounted to the first slider and a pair of second sliders mounted to the second guide shafts so as to be movable longitudinally of the second guide shafts that extend parallel to the direction of movement of the second bag-attracting portion, and wherein the holding members are mounted to their respective second sliders.

28. The bagging machine of claim 26, wherein the bag-moving means further includes a lever whose front end is pivotally mounted to the first slider, a cam maintained in contact with the lever, and a driving means for rotating the cam, the lever being tiltable longitudinally of the first guide shaft, and wherein when the driving means is operated, the cam is rotated to drive the first slider via the lever so that the first slider may reciprocate between the bag-opening means and the bag-sealing means.

29. A bagging machine adapted for opening and filling with selected articles a bag having at least two plies, comprising:

a bag supply means having a mounting member adapted to reciprocate between a bag supply position and a bag opening position;

a first bag-attracting portion coupled to the mounting member and positionable adjacent one side of a first bag ply surface;

bag opening means having a second bag-attracting portion positionable adjacent one side of a second bag ply surface, the second bag-attracting portion cooperating with the first bag-attracting portion to open the bag when the mounting member of the bag supply means is in the bag opening position and the second bag-attracting portion movable in a first direction toward and away from the first bag-attracting portion in a second direction relative to the first direction when the second bag-attracting portion is in an abutting position with the first bag-attracting portion so as to hold the bag therebetween while offsetting the first and second bag-attracting portions relative to one another while opening the bag;

bag-filling means for putting the selected articles in the bag;

bag-sealing means for closing the bag after opening and filling the bag; and bag-moving means for transporting the bag among the bag opening, filling and closing positions.

* * * * *